US008605930B2

(12) United States Patent
Takano et al.

(10) Patent No.: US 8,605,930 B2
(45) **Date of Patent: *Dec. 10, 2013**

(54) MICROPHONE UNIT, CLOSE-TALKING TYPE SPEECH INPUT DEVICE, INFORMATION PROCESSING SYSTEM, AND METHOD FOR MANUFACTURING MICROPHONE UNIT

(75) Inventors: Rikuo Takano, Tsukuba (JP); Kiyoshi Sugiyama, Mitaka (JP); Toshimi Fukuoka, Yokohama (JP); Masatoshi Ono, Tsukuba (JP); Ryusuke Horibe, Daito (JP); Fuminori Tanaka, Daito (JP); Hideki Chouji, Daito (JP); Takeshi Inoda, Daito (JP)

(73) Assignees: Funai Electric Co., Ltd., Osaka (JP); Funai Electric Advanced Applied Technology Research Institute Inc., Osaka (JP)

( * ) Notice: Subject to any disclaimer, the term of this patent is extended or adjusted under 35 U.S.C. 154(b) by 98 days.

This patent is subject to a terminal disclaimer.

(21) Appl. No.: 12/934,809

(22) PCT Filed: Mar. 27, 2009

(86) PCT No.: PCT/JP2009/056393

§ 371 (c)(1),
(2), (4) Date: Mar. 31, 2011

(87) PCT Pub. No.: WO2009/119852

PCT Pub. Date: Oct. 1, 2009

(65) Prior Publication Data

US 2011/0170726 A1 Jul. 14, 2011

(30) Foreign Application Priority Data

Mar. 27, 2008 (JP) ..... 2008-083294

(51) Int. Cl.
*H04R 9/08* (2006.01)

(52) U.S. Cl.
USPC ..... 381/355

(58) Field of Classification Search
USPC ..... 381/355
See application file for complete search history.

(56) References Cited

U.S. PATENT DOCUMENTS 5,226,076 A 7/1993 Baumhauer, Jr. et al.
8,180,082 B2 * 5/2012 Takano et al. ..... 381/322

(Continued)

FOREIGN PATENT DOCUMENTS

EP 0827360 A2 3/1998
GB 2218303 A * 11/1989

(Continued)

OTHER PUBLICATIONS

Office Action issued in corresponding Chinese Application No. 200980111077.3 dated Nov. 2, 2012, and English translation thereof (18 pages).

(Continued)

*Primary Examiner* — Brian Ensey
*Assistant Examiner* — Katherine Faley
(74) *Attorney, Agent, or Firm* — Osha Liang LLP

(57) ABSTRACT

A microphone unit 1 of the present invention includes a case 10 having an internal space 100, a partition member 20 which is provided in the case, and at least partially composed of a vibrating membrane 30, that splits the internal space into a first space 102 and a second space 104, and an electrical signal output circuit 40 that outputs an electrical signal on the basis of vibration of the vibrating membrane. A first through hole 12 through which the first space 102 and an external space of the case are communicated with each other, and a second through hole 14 through which the second space 104 and the external space of the case are communicated with each other are formed in the case 10. In accordance with the present invention, it is possible to provide a high-quality microphone unit whose outer shape is small and which is capable of performing thorough noise cancellation.

16 Claims, 27 Drawing Sheets

(56) References Cited

U.S. PATENT DOCUMENTS

| | | | | |
|---|---|---|---|---|
| 2004/0178938 | A1* | 9/2004 | Pedersen | 341/143 |
| 2005/0094832 | A1* | 5/2005 | Song et al. | 381/174 |
| 2012/0201410 | A1* | 8/2012 | Takano et al. | 381/355 |

FOREIGN PATENT DOCUMENTS

| | | | |
|---|---|---|---|
| JP | 48-21519 | A | 3/1973 |
| JP | 63-232798 | A | 9/1988 |
| JP | 1-268398 | A | 10/1989 |
| JP | 4-076795 | A | 3/1992 |
| JP | 4-217199 | A | 8/1992 |
| JP | 5-260580 | A | 10/1993 |
| JP | 6-284494 | A | 10/1994 |
| JP | 7-312638 | A | 11/1995 |
| JP | 08-191496 | A | 7/1996 |
| JP | 9-331377 | A | 12/1997 |
| JP | 2001-186241 | A | 7/2001 |
| JP | 2005-295278 | A | 10/2005 |
| WO | 00/38477 | A2 | 6/2000 |

OTHER PUBLICATIONS

Extended European Search Report issued in corresponding European Application No. 09725960.0 dated Dec. 13, 2012 (7 pages).

International Preliminary Report on Patentability and Written Opinon issued in corresponding International Application No. PCT/JP2009/056393 dated Nov. 9, 2010 (10 pages).

* cited by examiner

1kHz

Δr=5mm

MICROPHONE-TO-SOUND SOURCE DISTANCE 2.5 cm

MICROPHONE-TO-SOUND SOURCE DISTANCE 1 m

1kHz

Δr=10mm

MICROPHONE-TO-SOUND SOURCE DISTANCE 2.5 cm

MICROPHONE-TO-SOUND SOURCE DISTANCE 1 m

1kHz

Δr=20mm

MICROPHONE-TO-SOUND SOURCE DISTANCE 2.5 cm

MICROPHONE-TO-SOUND SOURCE DISTANCE 1 m

7kHz

Δr=5mm

MICROPHONE-TO-SOUND SOURCE DISTANCE 2.5 cm

MICROPHONE-TO-SOUND SOURCE DISTANCE 1 m

7kHz

Δr=10mm

MICROPHONE-TO-SOUND SOURCE DISTANCE 2.5 cm

MICROPHONE-TO-SOUND SOURCE DISTANCE 1 m

7kHz

Δr=20mm

MICROPHONE-TO-SOUND SOURCE DISTANCE 2.5 cm

MICROPHONE-TO-SOUND SOURCE DISTANCE 1 m

300Hz

Δr=5mm

MICROPHONE-TO-SOUND SOURCE DISTANCE 2.5 cm

MICROPHONE-TO-SOUND SOURCE DISTANCE 1 m

300Hz

Δr=10mm

MICROPHONE-TO-SOUND SOURCE DISTANCE 2.5 cm

MICROPHONE-TO-SOUND SOURCE DISTANCE 1 m

300Hz

Δr=20mm

MICROPHONE-TO-SOUND SOURCE DISTANCE 2.5 cm

MICROPHONE-TO-SOUND SOURCE DISTANCE 1 m

MICROPHONE UNIT, CLOSE-TALKING TYPE SPEECH INPUT DEVICE, INFORMATION PROCESSING SYSTEM, AND METHOD FOR MANUFACTURING MICROPHONE UNIT

TECHNICAL FIELD

The present invention relates to a microphone unit, a close-talking type speech input device, an information processing system, and a method for manufacturing the microphone unit.

BACKGROUND ART

At the time of a conversation by telephone or the like, speech recognition, speech recording, and the like, it is preferable to collect a target speech (a voice of a user). Meanwhile, in some cases, a sound other than a target speech such as a background noise exists depending on a usage environment of a speech input device. Therefore, the development of a speech input device having a function that enables the device to reliably extract a speech of a user, i.e., which cancels the noise even in a case where the device is used in a noisy environment, has been advanced.

As a technology for canceling a noise in a noisy environment, providing sharp directivity to a microphone unit, or a method for canceling a noise such that directions of the incoming sound waves are identified by utilizing a difference in times of incoming sound waves, to perform signal processing, has been known (for example, refer to JP-A-7-312638, JP-A-9-331377, and JP-A-2001-186241).

Further, in recent years, the downsizing of electronics has been advanced, and the emphasis has been on a technology for downsizing a speech input device.

DISCLOSURE OF THE INVENTION

Problem to be Solved by the Invention

In order to provide sharp directivity to a microphone unit, it is necessary to array a large number of vibrating membranes, which makes it difficult to downsize the microphone unit.

Further, in order to accurately detect directions of the incoming sound waves by utilizing a difference in times of incoming sound waves, it is necessary to install a plurality of vibrating membranes approximately every several wavelengths of an audible sound wave. Accordingly, it is difficult to downsize a microphone unit.

An object of the present invention is to provide a high-quality microphone unit whose outer shape is small and which is capable of performing thorough noise cancellation, a close-talking type speech input device, an information processing system, and a method for manufacturing the microphone unit.

Means for Solving the Problem (1) A microphone unit according to the present invention comprising: a case having an internal space; a partition member which is provided in the case, and at least partially composed of a vibrating membrane, the partition member that splits the internal space into a first space and a second space; and an electrical signal output circuit that outputs an electrical signal on the basis of vibration of the vibrating membrane, in which a first through hole through which the first space and an external space of the case are communicated with each other, and a second through hole through which the second space and the external space of the case are communicated with each other are formed in the case.

In accordance with the present invention, a user speech and a noise are incident to the both surfaces of the vibrating membrane. The noise components in the speech incident to the both surfaces of the vibrating membrane are substantially uniformed in sound pressure, and those therefore cancel each other in the vibrating membrane. Therefore, sound pressure vibrating the vibrating membrane may be regarded as sound pressure indicating a user speech, and an electrical signal acquired on the basis of the vibration of the vibrating membrane may be regarded as an electrical signal indicating a user speech whose noise is canceled.

With this, in accordance with the present invention, it is possible to provide a high-quality microphone unit capable of performing thorough noise cancellation with a simple configuration.

(2) In the microphone unit, the partition member may be provided so as not to allow a medium propagating a sound wave to move between the first and second spaces inside the case.

(3) In the microphone unit, an outer shape of the case is a polyhedron, and the first and second through holes may be formed in one surface of the polyhedron.

That is, in the microphone unit, the first and second through holes may be formed in the same surface of the polyhedron. In other words, the first and second through holes may be formed so as to be directed in the same direction. With this, since it is possible to (substantially) equalize sound pressures of noises incident from the first and second through holes into the case, it is possible to accurately cancel the noise.

(4) In the microphone unit, the vibrating membrane may be disposed such that a normal line of the vibrating membrane is parallel to the one surface.

(5) In the microphone unit, the vibrating membrane may be disposed such that a normal line of the vibrating membrane is perpendicular to the one surface.

(6) In the microphone unit, the vibrating membrane may be disposed so as not to overlap with the first or second through hole.

With this, even in the case where foreign matter enters into the internal space via the first and second through holes, it is possible to reduce the possibility that the vibrating membrane is directly damaged by the foreign matter.

(7) In the microphone unit, the vibrating membrane may be disposed beside the first or second through hole.

(8) In the microphone unit, the vibrating membrane may be disposed such that a distance from the first through hole and a distance from the second through hole are not equalized.

(9) In the microphone unit, the partition member may be disposed such that volumes of the first and second spaces are uniformed.

(10) In the microphone unit, a center-to-center distance between the first and second through holes may be 5.2 mm or less.

(11) In the microphone unit, at least a part of the electrical signal output circuit may be formed inside the case.

(12) In the microphone unit, the case may have a shielding structure of electromagnetically shielding the internal space from the external space of the case.

(13) In the microphone unit, the vibrating membrane may be composed of a transducer having SN ratio of approximately 60 decibels or more.

For example, the vibrating membrane may be composed of a transducer whose SN ratio is 60 decibels or more, or may be composed of a transducer whose SN ratio is 60±α decibels or more.

(14) In the microphone unit, a center-to-center distance between the first and second through holes may be set to a distance within a range in which sound pressure in the case where the vibrating membrane is used as a differential microphone does not exceed sound pressure in the case where the vibrating membrane is used as a single microphone with respect to a sound in a frequency band less than or equal to 10 kHz.

The first and second through holes may be disposed along a traveling direction of a sound (for example, a speech) of a sound source, and a center-to-center distance between the first and second through holes may be set to a distance within a range in which sound pressure in the case where the vibrating membrane is used as a differential microphone does not exceed sound pressure in the case where the vibrating membrane is used as a single microphone with respect to a sound from the traveling direction.

(15) In the microphone unit, a center-to-center distance between the first and second through holes may be set to a distance within a range in which sound pressure in the case where the vibrating membrane is used as a differential microphone does not exceed sound pressure in the case where the vibrating membrane is used as a single microphone in all directions with respect to a sound in an extractive target frequency band.

The extractive target frequency band is a frequency of a sound required to be extracted by the microphone. For example, a center-to-center distance between the first and second through holes may be set with a frequency less than or equal to 7 kHz serving as an extractive target frequency band.

(16) The present invention is a close-talking type speech input device in which the microphone unit according to any one of the above descriptions is mounted.

In accordance with this speech input device, it is possible to acquire an electrical signal indicating a user speech whose noise is accurately canceled. Therefore, in accordance with the present invention, it is possible to provide a speech input device capable of achieving highly accurate speech recognition processing and speech authentication processing, or command generation processing based on an input speech.

(17) In the speech input device according to the present invention, an outer shape of the case is a polyhedron, and the first and second through holes may be formed in one surface of the polyhedron.

(18) In the speech input device according to the present invention, a center-to-center distance between the first and second through holes may be 5.2 mm or less.

(19) In the speech input device according to the present invention, the vibrating membrane may be composed of a transducer having SN ratio of approximately 60 decibels or more.

(20) In the speech input device according to the present invention, a center-to-center distance between the first and second through holes may be set to a distance within a range in which sound pressure in the case where the vibrating membrane is used as a differential microphone does not exceed sound pressure in the case where the vibrating membrane is used as a single microphone with respect to a sound in a frequency band less than or equal to 10 kHz.

(21) In the speech input device according to the present invention, a center-to-center distance between the first and second through holes may be set to a distance within a range in which sound pressure in the case where the vibrating membrane is used as a differential microphone does not exceed sound pressure in the case where the vibrating membrane is used as a single microphone in all directions with respect to a sound in an extractive target frequency band.

(22) The present invention is an information processing system comprising: the microphone unit according to any one of the above descriptions; and an analysis processing unit that executes analysis processing of a speech incident to the microphone unit on the basis of the electrical signal.

In accordance with this information processing system, it is possible to acquire an electrical signal indicating a user speech whose noise is accurately canceled. Therefore, in accordance with the present invention, it is possible to provide a speech input device capable of achieving highly accurate speech recognition processing and speech authentication processing, or command generation processing based on an input speech.

(23) A method for manufacturing a microphone unit according to the present invention, the microphone unit including: a case having an internal space; a partition member which is provided in the case, and at least partially composed of a vibrating membrane, the partition member that splits the internal space into a first space and a second space; and an electrical signal output circuit that outputs an electrical signal on the basis of vibration of the vibrating membrane, the method comprising: setting a center-to-center distance between the first and second through holes to a distance within a range in which sound pressure in the case where the vibrating membrane is used as a differential microphone does not exceed sound pressure in the case where the vibrating membrane is used as a single microphone with respect to a sound in a frequency band less than or equal to 10 kHz; and forming a first through hole through which the first space and an external space of the case are communicated with each other, and a second through hole through which the second space and the external space of the case are communicated with each other, in the case according to the set center-to-center distance.

The first and second through holes may be disposed along a traveling direction of a sound (for example, a speech) of a sound source, and a center-to-center distance between the first and second through holes may be set to a distance within a range in which sound pressure in the case where the vibrating membrane is used as a differential microphone does not exceed sound pressure in the case where the vibrating membrane is used as a single microphone with respect to a sound from the traveling direction.

(24) A method for manufacturing a microphone unit according to the present invention, the microphone unit including: a case having an internal space; a partition member which is provided in the case, and at least partially composed of a vibrating membrane, the partition member that splits the internal space into a first space and a second space; and an electrical signal output circuit that outputs an electrical signal on the basis of vibration of the vibrating membrane, the method comprising: setting a center-to-center distance between the first and second through holes to a distance within a range in which sound pressure in the case where the vibrating membrane is used as a differential microphone does not exceed sound pressure in the case where the vibrating membrane is used as a single microphone in all directions with respect to a sound in an extractive target frequency band; and foaming a first through hole through which the first space and an external space of the case are communicated with each other, and a second through hole through which the second space and the external space of the case are communicated with each other, in the case according to the set center-to-center distance.

The extractive target frequency band is a frequency of a sound required to be extracted by the microphone, which may be, for example, a frequency less than or equal to 7 kHz.

DESCRIPTION OF REFERENCE NUMERALS

1: microphone unit, 2: speech input device, 3: microphone unit, 4: microphone unit, 5: microphone unit, 6: microphone unit, 7: microphone unit, 8: microphone unit, 9: microphone unit, 10: case, 11: case, 12: first through hole, 13: microphone unit, 14: second through hole, 16: convex curved surface, 17: concave curved surface, 18: spherical surface, 20: partition member, 21: partition member, 30: vibrating membrane, 31: vibrating membrane, 32: holding unit, 40: electrical signal output circuit, 41: vibrating membrane unit, 42: capacitor, 44: signal amplifier circuit, 45: gain adjusting circuit, 46: charge-up circuit, 48: operational amplifier, 50: case, 52: aperture, 54: elastic body, 60: arithmetic processing unit, 70: communication processing unit, 80: vibrating membrane, 100: internal space, 101: internal space, 102: first space, 104: second space, 112: first space, 114: second space, 110: external space, 112: first space, 114: second space, 122: first space, 124: second space, 132: first space, 134: second space, 200: condenser microphone, 202: vibrating membrane, 204: electrode, 300: mobile telephone, 400: microphone, 500: remote controller, 600: information processing system, 602: speech input device, 604: host computer.

BEST MODES FOR CARRYING OUT THE INVENTION

Hereinafter, an embodiment to which the present invention is applied will be described with reference to the accompanying drawings. However, the present invention is not limited to the following embodiment. Further, the present invention includes the freely-combined following contents.

1. CONFIGURATION OF MICROPHONE UNIT 1

Figure 1:
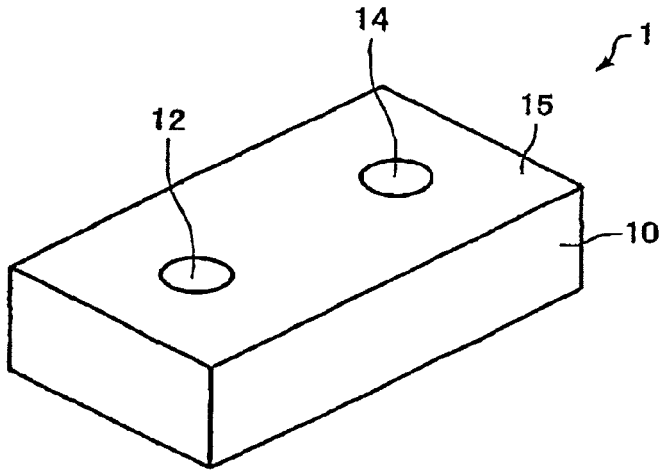
FIG. 1 is a view for explanation of a microphone unit.
Figure 2:
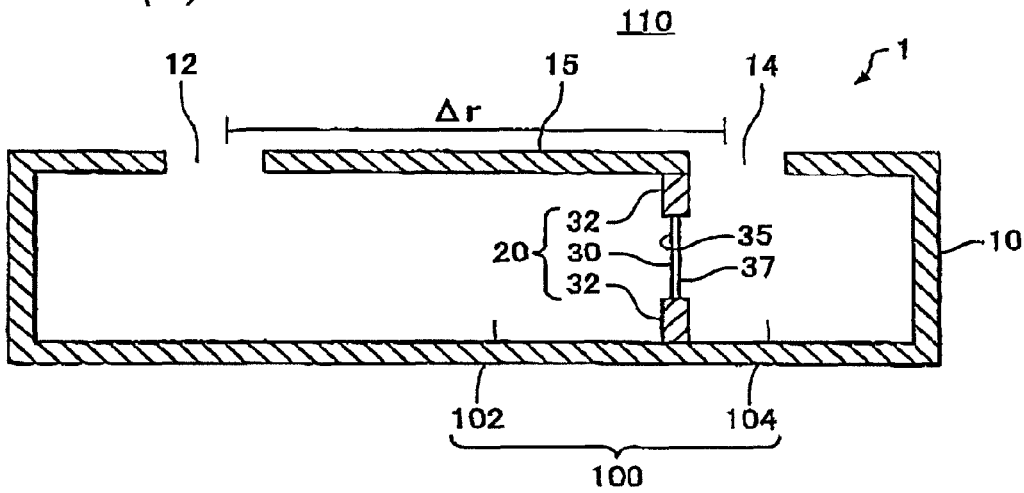
FIG. 2 is a view for explanation of a microphone unit.
Figure 2:
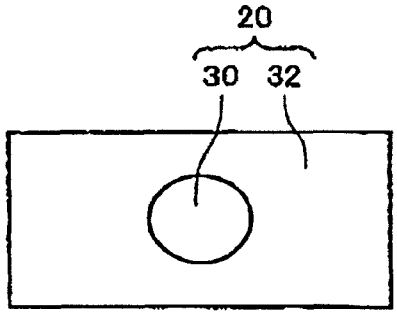

First, the configuration of a microphone unit 1 according to a present embodiment will be described. FIG. 1 is a schematic perspective view of the microphone unit 1. Further, FIG. 2(A) is a schematic cross-sectional view of the microphone unit 1. Further, FIG. 2(B) is a view of a partition member 20 observed from the front.

As shown in FIGS. 1 and 2(A), the microphone unit 1 according to the present embodiment includes a case 10. The case 10 is a member forming an outer shape of the microphone unit 1. The outer shape of the case 10 (the microphone unit 1) may have a polyhedral structure. The outer shape of the case 10 may be a hexahedron (a rectangular parallelepiped or a cube) as shown in FIG. 1. Meanwhile, the outer shape of the case 10 may have a polyhedral structure other than a hexahedron. Or, the outer shape of the case 10 may have a structure such as a globular structure (a hemispheroidal structure) other than a polyhedron.

As shown in FIG. 2(A), the case 10 compartments an internal space 100 (a first space 102 and a second space 104) and an external space (an external space 110). The case 10 may have a shielding structure (an electromagnetic shield structure) of electrically and magnetically shielding the internal space 100 from the external space 110. Thereby, a vibrating membrane 30 and an electrical signal output circuit 40 which are disposed inside the internal space 100 of the case 10 which will be described later, may be made less affected by electronic components disposed in the external space 110 of the case 10. Accordingly, the microphone unit 1 according to the present embodiment has a highly accurate noise-canceling function.

As shown in FIGS. 1 and 2(A), through holes for making the internal space 100 of the case 10 and the external space 110 communicate with each other are formed in the case 10. In the present embodiment, a first through hole 12 and a second through hole 14 are formed in the case 10. Here, the first through hole 12 is a through hole for making the first space 102 and the external space 110 communicate with each other. Further, the second through hole 14 is a through hole for making the second space 104 and the external space 110 communicate with each other. In addition, the first space 102 and the second space 104 will be described later in detail. The shapes of the first through hole 12 and the second through hole 14 are not particularly limited. For example, they may form a circular shape as shown in FIG. 1. Meanwhile, the shapes of the first through hole 12 and the second through hole 14 may be shapes other than circular shapes, and may be rectangles, for example.

In the present embodiment, as shown in FIGS. 1 and 2(A), the first through hole 12 and the second through hole 14 are formed in one surface 15 of the case 10 forming the hexahedral structure (polyhedral structure). Meanwhile, as a modified example, the first through hole 12 and the second through hole 14 may be respectively formed in different surfaces of the polyhedron. For example, the first through hole 12 and the second through hole 14 may be formed in surfaces facing each other of a hexahedron, and may be formed in adjacent surfaces of a hexahedron. Further, in the present embodiment, the one first through hole 12 and the one second through hole 14 are each formed in the case 10. Meanwhile, a plurality of the first through holes 12 and a plurality of the second through holes 14 may be formed in the case 10.

As shown in FIGS. 2(A) and 2(B), the microphone unit 1 according to the present embodiment includes a partition member 20. Here, FIG. 2(B) is a view of the partition member 20 observed from the front. The partition member 20 is provided in the case 10 so as to split the internal space 100. In the present embodiment, the partition member 20 is provided so as to split the internal space 100 into the first space 102 and the second space 104. That is, the first space 102 and the second space 104 may be respectively said to be spaces compartmented by the case 10 and the partition member 20.

The partition member 20 may be provided so as not to allow a medium propagating a sound wave to move (to be incapable of moving) between the first space 102 and the second space 104 inside the case 10. For example, the partition member 20 may be an airtight bulkhead, which segregates the internal space 100 (the first space 102 and the second space 104) in an airtight manner inside the case 10.

As shown in FIGS. 2(A) and 2(B), the partition member 20 is at least partially composed of the vibrating membrane 30. The vibrating membrane 30 is a member vibrating in a normal direction when a sound wave is incident thereto. Then, the microphone unit 1 acquires an electrical signal indicating a speech incident to the vibrating membrane 30 by extracting an electrical signal on the basis of the vibration of the vibrating membrane 30. That is, the vibrating membrane 30 may be a vibrating membrane of a microphone (an electro-acoustic transducer that converts an acoustic signal into an electrical signal).

Figure 3:
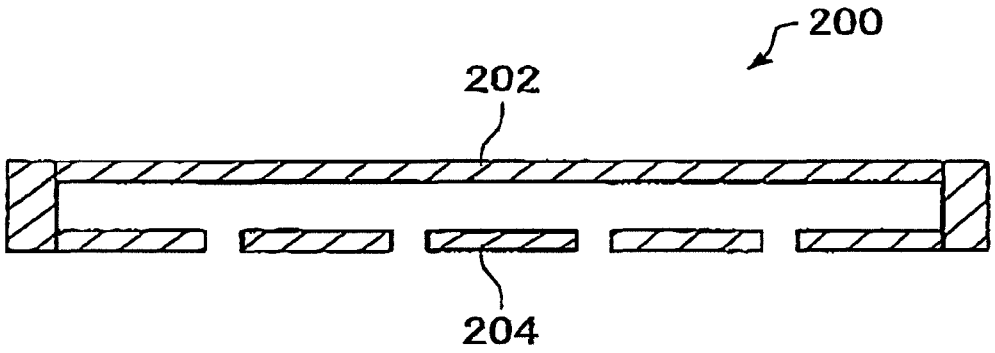
FIG. 3 is a view for explanation of a microphone unit.

Hereinafter, the configuration of a condenser microphone 200 which may have applicability to the microphone 1 according to the present embodiment, will be described. In addition, FIG. 3 is a view for explanation of the condenser microphone 200.

The condenser microphone 200 has a vibrating membrane 202. In addition, the vibrating membrane 202 corresponds to the vibrating membrane 30 in the microphone unit 1 according to the present embodiment. The vibrating membrane 202 is a membrane (thin membrane) receiving a sound wave to vibrate, which is electrically conductive and forms one end of an electrode. The condenser microphone 200 further has an electrode 204. The electrode 204 is disposed so as to face the vibrating membrane 202. Accordingly, the vibrating membrane 202 and the electrode 204 form a capacitance. When a sound wave is incident to the condenser microphone 200, the vibrating membrane 202 vibrates, and an interval between the vibrating membrane 202 and the electrode 204 changes, which changes an electrostatic capacitance between the vibrating membrane 202 and the electrode 204. By retrieving the change in electrostatic capacitance as, for example, a change in voltage, it is possible to acquire an electrical signal based on vibration of the vibrating membrane 202. That is, it is possible to convert a sound wave incident to the condenser microphone 200 into an electrical signal, to output the electrical signal. In addition, in the condenser microphone 200, the electrode 204 may be configured so as not to be affected by a sound wave. For example, the electrode 204 may have a mesh structure.

In addition, the vibrating membrane 30 of the microphone 1 according to the present embodiment is not limited to the above-described condenser microphone 200, and vibrating membranes for various sorts of microphones, such as electrodynamic (dynamic type), electromagnetic (magnetic type), and piezoelectric (crystal type) microphones may be applied as the vibrating membrane 30.

Or, the vibrating membrane 30 may be a semiconductor film (for example, a silicon film). That is, the vibrating membrane 30 may be a vibrating membrane for a silicon microphone (Si microphone). Provided that a silicon microphone is used, it is possible to downsize the microphone unit 1 and realize the microphone unit 1 with high performance.

The outer shape of the vibrating membrane 30 is not particularly limited. As shown in FIG. 2(B), the outer shape of the vibrating membrane 30 may be formed a circular shape. At this time, the vibrating membrane 30, the first through hole 12, and the second through hole 14 may be circular shapes whose diameters are (substantially) the same. Meanwhile, the vibrating membrane 30 may be larger or smaller than the first through hole 12 and the second through hole 14. Further, the vibrating membrane 30 has a first surface 35 and a second surface 37. The first surface 35 is a surface of the vibrating membrane 30 on the side of the first space 102, and the second surface 37 is a surface of the vibrating membrane 30 on the side of the second space 104.

In addition, in the present embodiment, as shown in FIG. 2(A), the vibrating membrane 30 may be provided such that its normal extends parallel to the surface 15 of the case 10. In other words, the vibrating membrane 30 may be provided so as to be perpendicular to the surface 15. Then, the vibrating membrane 30 may be disposed beside (in the vicinity of) the second through hole 14. That is, the vibrating membrane 30 may be disposed such that a distance from the first through hole 12 and a distance from the second through hole 14 are not equalized. Meanwhile, as a modified example, the vibrating membrane 30 may be disposed at the midpoint between the first through hole 12 and the second through hole 14.

In the present embodiment, as shown in FIGS. 2(A) and 2(B), the partition member 20 may include a holding unit 32 that holds the vibrating membrane 30. Then, the holding unit 32 may be in close contact with the inner wall surface of the case 10. By making the holding unit 32 in close contact with the inner wall surface of the case 10, it is possible to segregate the first space 102 and the second space 104 in an airtight manner.

The microphone unit 1 according to the present embodiment includes the electrical signal output circuit 40 that outputs an electrical signal on the basis of vibration of the vibrating membrane 30. The electrical signal output circuit 40 may be formed at least partially inside the internal space 100 of the case 10. The electrical signal output circuit 40 may be formed on the inner wall surface of the case 10, for example. That is, in the present embodiment, the case 10 may be utilized as a circuit substrate for an electric circuit.

Figure 4:
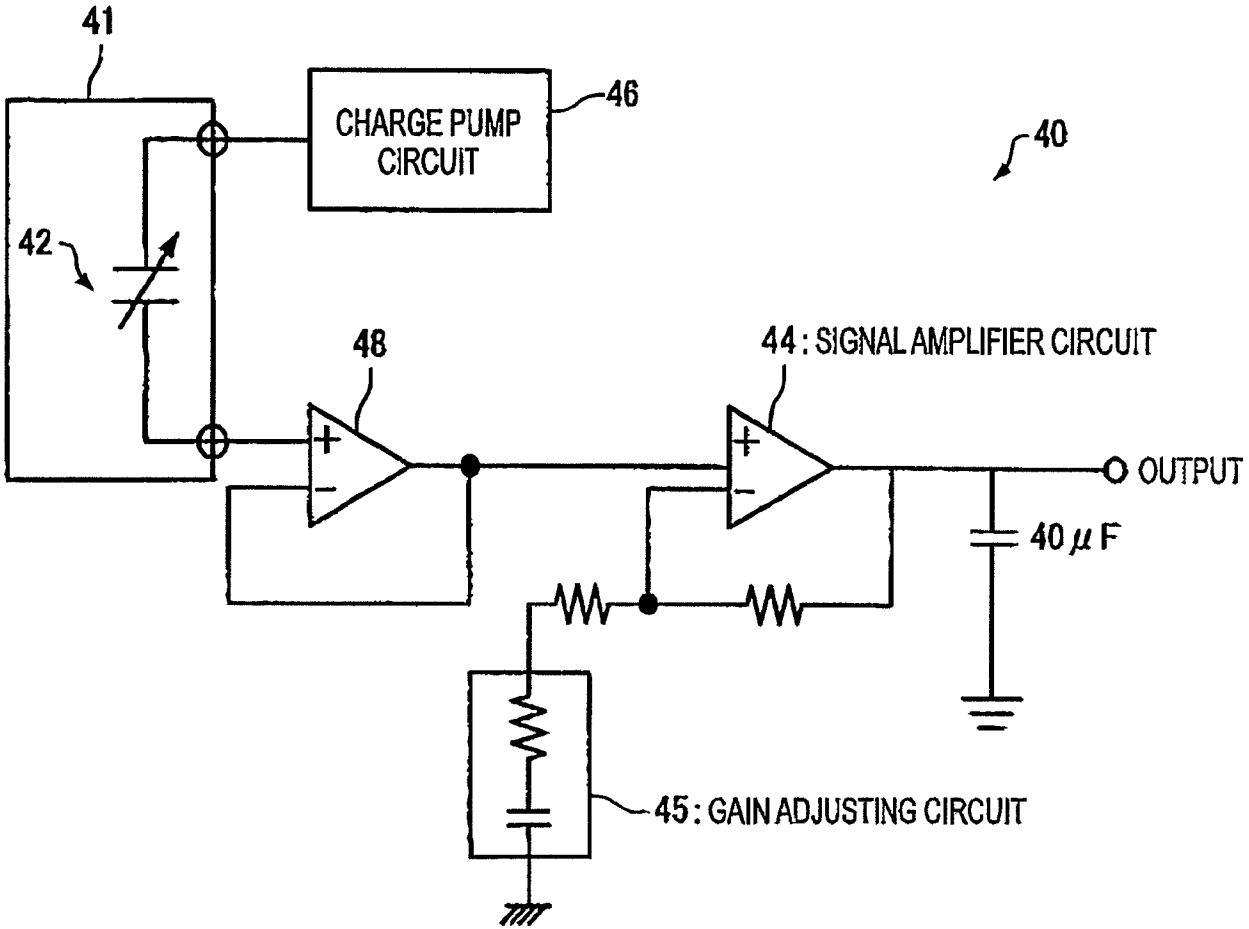
FIG. 4 is a view for explanation of a microphone unit.

FIG. 4 shows an example of the electrical signal output circuit 40 which may have applicability to the microphone unit 1 according to the present embodiment. The electrical signal output circuit 40 may be configured to amplify an electrical signal based on a change in electrostatic capacitance of a capacitor 42 (a condenser microphone having the vibrating membrane 30) with a signal amplifier circuit 44 to output it. The capacitor 42 may compose a part of a vibrating membrane unit 41, for example. In addition, the electrical signal output circuit 40 may be composed of a charge-up circuit 46 and an operational amplifier 48. Thereby, it is possible to precisely acquire a change in electrostatic capacitance of the capacitor 42. In the present embodiment, for example, the capacitor 42, the signal amplifier circuit 44, the charge-up circuit 46, and the operational amplifier 48 may be formed on the inner wall surface of the case 10. Further, the electrical signal output circuit 40 may include a gain adjusting circuit 45. The gain adjusting circuit 45 functions to adjust a gain of the signal amplifier circuit 44. The gain adjusting circuit 45 may be provided inside the case 10, and may be provided outside the case 10.

Meanwhile, in the case where a silicon microphone is applied as the vibrating membrane 30, the electrical signal output circuit 40 may be realized by forming an integrated circuit on a semiconductor substrate provided in the silicon microphone.

Further, the electrical signal output circuit 40 may further include a conversion circuit that converts an analog signal into a digital signal, a compression circuit that compresses (encodes) a digital signal, and the like.

Further, the vibrating membrane 30 may be composed of a transducer whose SN ratio is approximately 60 decibels or more. In the case where a transducer is functioned as a differential microphone, its SN ratio deteriorates as compared with the case where a transducer is functioned as a single microphone. Accordingly, provided that the vibrating membrane 30 is composed of a transducer whose SN ratio is excellent (for example, an MEMS transducer whose SN ratio is approximately 60 decibels or more), it is possible to realize a sensitive microphone unit.

For example, in the case where a single microphone is used as a differential microphone by setting a distance between a speaker and the microphone to approximately 2.5 cm (a close-talking type microphone unit), its sensitivity deteriorates approximately ten-odd decibels as compared with the case where the microphone is used as a single microphone. However, the microphone unit 1 according to the present embodiment has the vibrating membrane 30 composed of a transducer whose SN ratio is approximately 60 decibels or more, thereby the microphone unit 1 is provided with an necessary sensitivity level for functioning as a microphone.

As described above, the microphone unit 1 according to the present embodiment has a highly accurate noise-canceling function regardless of its simple configuration. Hereinafter, the principle of noise-cancellation of the microphone unit 1 will be described.

2. PRINCIPLE OF NOISE-CANCELLATION OF THE MICROPHONE UNIT 1

(1) Configuration of the Microphone Unit 1 and Principle of Vibration of the Vibrating Membrane 30

First, the principle of vibration of the vibrating membrane 30 derived from the configuration of the microphone unit 1 will be described.

In the microphone unit 1 according to the present embodiment, the vibrating membrane 30 receives sound pressures from the both sides (the first surface 35 and the second surface 37). Therefore, when sound pressures at the same level are simultaneously exerted onto the both sides of the vibrating membrane 30, the two sound pressures cancel each other in the vibrating membrane 30, which do not result in force vibrating the vibrating membrane 30. In contrast thereto, when there is a difference between the sound pressures received by the both sides of the vibrating membrane 30, the vibrating membrane 30 is vibrated by the difference between the sound pressures.

Further, the sound pressures of sound waves incident into the first through hole 12 and the second through hole 14 are uniformly transmitted to the inner wall surfaces of the first space 102 and the second space 104 according to Pascal's law. Therefore, the surface (the first surface 35) of the vibrating membrane 30 on the side of the first space 102 receives sound pressure equal to the sound pressure incident into the first through hole 12, and the surface (the second surface 37) of the vibrating membrane 30 on the side of the second space 104 receives sound pressure equal to the sound pressure incident into the second through hole 14.

That is, the sound pressures received by the first surface 35 and the second surface 37 are respectively the sound pressures of the sounds incident into the first through hole 12 and the second through hole 14, and the vibrating membrane 30 vibrates by a difference between the sound pressures of the sound waves incident from the first through hole 12 and the second through hole 14 to reach the first surface 35 and the second surface 37.

(2) Property of Sound Wave

A sound wave is attenuated as it travels in a medium, and its sound pressure (an intensity and an amplitude of the sound wave) deteriorates. Since sound pressure is reversely proportional to a distance from a sound source, sound pressure P may be, in a relationship with a distance R from the sound source, expressed as follows:

[Expression 1]

$$P = K\frac{1}{R} \tag{1}$$

Figure 5:
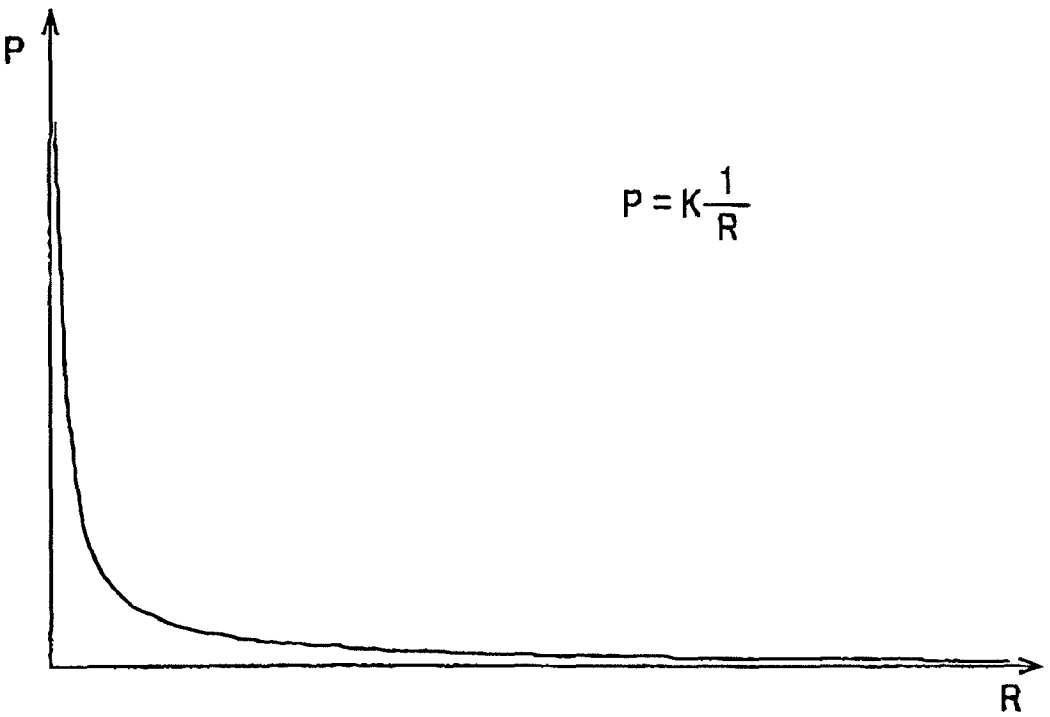
FIG. 5 is a view for explanation of the attenuation characteristics of a sound wave.

In addition, in expression (1) is a proportional constant. FIG. 5 shows a graph showing a relationship between sound pressures P and distances R from the sound source by the expression (1). As is shown in the graph, sound pressure (the amplitude of the sound wave) is rapidly attenuated at a position close to the sound source (on the left side of the graph), and is gradually attenuated as it moves away from the sound source.

In the case where the microphone unit 1 is applied to a close-talking type sound input apparatus, a speech of a user is generated from the vicinity of the first through hole 12 and the second through hole 14 of the microphone unit 1. Therefore, the speech of the user is greatly attenuated between the first through hole 12 and the second through hole 14, which shows a great difference between the sound pressures of the speech of a user incident into the first through hole 12 and the second through hole 14, i.e., the sound pressures of the speech of the user incident into the first surface 35 and the second surface 37.

In contrast thereto, a sound source of a noise component exists at a distant position from the first through hole 12 and the second through hole 14 of the microphone unit 1 as compared with the speech of the user. Therefore, the sound pressures of noises are hardly attenuated between the first through hole 12 and the second through hole 14, which hardly shows a difference between the sound pressures of the noise input into the first through hole 12 and the second through hole 14.

(3) Principle of Noise-Cancellation

As described above, the vibrating membrane 30 is vibrated by a difference between sound pressures of sound waves simultaneously incident to the first surface 35 and the second surface 37. Then, since a difference between sound pressures of noises incident to the first surface 35 and the second surface 37 is extremely small, the difference is canceled in the vibrating membrane 30. In contrast thereto, since a difference between sound pressures of a user speech incident to the first surface 35 and the second surface 37 is great, the difference is not canceled in the vibrating membrane 30, which vibrates the vibrating membrane 30.

With this, the vibrating membrane 30 of the microphone unit 1 may be considered to be vibrated by a user speech. Therefore, an electrical signal output from the electrical signal output circuit 40 of the microphone unit 1 may be regarded as a signal indicating the user speech whose noise is canceled.

That is, provided that the microphone unit 1 according to the present embodiment is applied to a speech input device, it is possible to acquire an electrical signal indicating a user speech whose noise is canceled with a simple configuration.

3. CONDITIONS FOR ACHIEVING A HIGHER ACCURACY NOISE-CANCELING FUNCTION BY THE MICROPHONE UNIT 1

As described above, in accordance with the microphone unit 1, it is possible to acquire an electrical signal indicating a user speech whose noise is canceled. However, the sound waves include their phase components. Therefore, considering a phase difference between the sound waves incident from the first through hole 12 and the second through hole 14 to the first surface 35 and the second surface 37 of the vibrating membrane 30, it is possible to derive the conditions under which it is possible to achieve a higher accuracy noise-canceling function (the design conditions of the microphone unit 1). Hereinafter, the conditions required to be fulfilled by the microphone unit 1 in order to achieve a higher accuracy noise-canceling function, will be described.

In accordance with the microphone unit 1, a noise component included in a sound pressure difference vibrating the vibrating membrane 30 (a difference between sound pressures received by the first surface 35 and the second surface 37: hereinafter called "differential sound pressure") may be made less than a noise component included in sound pressures incident to the first surface 35 and the second surface 37. To describe in more detail, a noise intensity ratio indicating a ratio of an intensity of the noise component included in the differential sound pressure to an intensity of the noise component included in the sound pressures incident to the first surface 35 or the second surface 37, is made less than a user speech intensity ratio indicating a ratio of an intensity of a user speech component included in the differential sound pressure to an intensity of a user speech component included in sound pressures incident to the first surface 35 or the second surface 37. Thus, since the microphone unit 1 has an excellent noise-canceling function, it is possible to regard a signal output on the basis of a differential sound pressure vibrating the vibrating membrane 30 as a signal indicating a user speech.

Hereinafter, the concrete conditions required to be fulfilled by the microphone unit 1 (the case 10) in order to achieve the noise-canceling function, will be described.

First, the sound pressures of a speech incident to the first surface 35 and the second surface 37 of the vibrating membrane 30 (the first through hole 12 and the second through hole 14) will be considered. Given that a distance from a sound source of a user speech to the first through hole 12 is R, and a center-to-center distance of the first through hole 12 and the second through hole 14 is Δr, when ignoring a phase difference, sound pressures (intensities) P(S1) and P(S2) of a user speech incident into the first through hole 12 and the second through hole 14 may be expressed as follows:

[Expression 2]

$$\begin{cases} P(S1) = K\dfrac{1}{R} & (2) \\ P(S2) = K\dfrac{1}{R+\Delta r} & (3) \end{cases}$$

Therefore, a user speech intensity ratio ρ(P) indicating a percentage of an intensity of a user speech component included in a differential sound pressure to an intensity of the sound pressure of the user speech incident to the first surface 35 (the first through hole 12) when ignoring a phase difference of the user speech, is expressed as follows:

[Expression 3]

$$\rho(P) = \frac{P(S1) - P(S2)}{P(S1)} = \frac{\Delta r}{R + \Delta r} \quad (4)$$

Here, in the case where the microphone unit 1 is utilized for a close-talking type speech input device, Δr may be considered to be sufficiently less than R.

Accordingly, the above-described expression (4) may be modified as follows:

[Expression 4]

$$\rho(P) = \frac{\Delta r}{R} \quad (A)$$

That is, it is shown that a user speech intensity ratio when ignoring a phase difference of a user speech is expressed by expression (A).

Meanwhile, considering a phase difference of a user speech, sound pressures Q(S1) and Q(S2) of the user speech may be expressed as follows:

[Expression 5]

$$\begin{cases} Q(S1) = K\frac{1}{R}\sin\omega t & (5) \\ Q(S2) = K\frac{1}{R + \Delta r}\sin(\omega t - \alpha) & (6) \end{cases}$$

In addition, α in the expression is a phase difference.

At this time, a user speech intensity ratio ρ(S) is expressed as follows:

[Expression 6]

$$\rho(S) = \frac{|P(S1) - P(S2)|_{max}}{|P(S1)|_{max}} = \frac{\left|\frac{K}{R}\sin\omega t - \frac{K}{R + \Delta r}\sin(\omega t - \alpha)\right|_{max}}{\left|\frac{K}{R}\sin\omega t\right|_{max}} \quad (7)$$

Considering expression (7), a level of the user speech intensity ratio ρ(S) may be expressed as follows:

[Expression 7]

$$\rho(S) = \frac{\frac{K}{R}\left|\sin\omega t - \frac{1}{1 + \Delta r/R}\sin(\omega t - \alpha)\right|_{max}}{\frac{K}{R}|\sin\omega t|_{max}} = \frac{1}{1 + \Delta r/R}|(1 + \Delta r/R)\sin\omega t - \sin(\omega t - \alpha)|_{max} = \frac{1}{1 + \Delta r/R}\left|\sin\omega t - \sin(\omega t - \alpha) + \frac{\Delta r}{R}\sin\omega t\right|_{max} \quad (8)$$

Meanwhile, in expression (8), the term of Sin ωt−Sin(ωt−α) indicates an intensity ratio of phase components, and the term of Δr/R sin ωt indicates an intensity ratio of amplitude components. Phase difference components, even when they are the user speech components, are noises for amplitude components. Therefore, in order to accurately extract a user speech, it is necessary for an intensity ratio of phase components to be sufficiently less than an intensity ratio of amplitude components. That is, it is important that Sin ωt−Sin(ωt−α) and Δr/R sin ωt fulfill the relationship as follows:

[Expression 8]

$$\left|\frac{\Delta r}{R}\sin\omega t\right|_{max} > |\sin\omega t - \sin(\omega t - \alpha)|_{max} \quad (B)$$

Here, the following expression may be derived:

[Expression 9]

$$\sin\omega t - \sin(\omega t - \alpha) = 2\sin\frac{\alpha}{2}\cdot\cos\left(\omega t - \frac{\alpha}{2}\right) \quad (9)$$

Therefore, the above-described expression (B) may be expressed as follows:

[Expression 10]

$$\left|\frac{\Delta r}{R}\sin\omega t\right|_{max} > \left|2\sin\frac{\alpha}{2}\cdot\cos\left(\omega t - \frac{\alpha}{2}\right|_{max} \quad (10)$$

Considering the amplitude components of expression (10), it is shown that it is necessary for the microphone unit 1 according to the present embodiment to fulfill the following expression:

[Expression 11]

$$\frac{\Delta r}{R} > 2\sin\frac{\alpha}{2} \quad (C)$$

In addition, as described above, since Δr may be considered to be sufficiently less than R, sin(α/2) may be considered to be sufficiently small, and may be approximated by the following expression:

[Expression 12]

$$\sin\frac{\alpha}{2} \approx \frac{\alpha}{2} \quad (11)$$

Therefore, expression (C) may be modified as follows:

[Expression 13]

$$\frac{\Delta r}{R} > \alpha \quad (D)$$

Further, when a relationship between α which is a phase difference and Δr is expressed as follows:

[Expression 14]

$$\alpha = \frac{2\pi\Delta r}{\lambda} \tag{12}$$

Expression (D) may be modified as follows:

[Expression 15]

$$\frac{\Delta r}{R} > 2\pi\frac{\Delta r}{\lambda} > \frac{\Delta r}{\lambda} \tag{E}$$

That is, in the present embodiment, when the microphone unit 1 fulfills the relationship shown by expression (E), it is possible to accurately extract a user speech.

Next, sound pressures of noises incident into the first through hole 12 and the second through hole 14 to reach the first surface 35 and the second surface 37 will be considered.

Given that an amplitude of a noise component incident from the first through hole 12 to reach the first surface 35 is A, and an amplitude of a noise component incident from the second through hole 14 to reach the second surface 37 is A', sound pressures Q(S1) and Q(S2) of the noise when considering a phase difference component, may be expressed as follows:

[Expression 16]

$$\begin{cases} Q(N1) = A\sin\omega t & (13) \\ Q(N2) = A'\sin(\omega t - \alpha) & (14) \end{cases}$$

A noise intensity ratio ρ(N) indicating a percentage of an intensity of the noise component included in a differential sound pressure to an intensity of the sound pressure of the noise component incident from the first through hole 12 to reach the first surface 35, may be expressed as follows:

[Expression 17]

$$\rho(N) = \frac{|Q(N1) - Q(N2)|_{max}}{|Q(N1)|_{max}} = \frac{|A\sin\omega t - A'\sin(\omega t - \alpha)|_{max}}{|A\sin\omega t|_{max}} \tag{15}$$

In addition, as described above, since the amplitude (the intensity) of the noise component incident from the first through hole 12 to reach the first surface 35 and the amplitude (the intensity) of the noise component incident from the second through hole 14 to reach the second surface 37 are substantially the same, those may be handled as A=A'. Accordingly, the above-described expression (15) may be modified as follows:

[Expression 18]

$$\rho(N) = \frac{|\sin\omega t - \sin(\omega t - \alpha)|_{max}}{|\sin\omega t|_{max}} \tag{16}$$

Then, a level of the noise intensity ratio may be expressed as follows:

[Expression 19]

$$\rho(N) = \frac{|\sin\omega t - \sin(\omega t - \alpha)|_{max}}{|\sin\omega t|_{max}} = |\sin\omega t - \sin(\omega t - \alpha)|_{max} \tag{17}$$

Here, considering the above-described expression (9), the expression (17) may be modified as follows:

[Expression 20]

$$\rho(N) = \left|\cos\left(\omega t - \frac{\alpha}{2}\right)\right|_{max} \cdot 2\sin\frac{\alpha}{2} = 2\sin\frac{\alpha}{2} \tag{18}$$

Then, considering the above-described expression (17), the expression (18) may be modified as follows:

[Expression 21]

$$\rho(N)=\alpha \tag{19}$$

Here, with reference to expression (D), a level of the noise intensity ratio may be expressed as follows:

[Expression 22]

$$\rho(N) = \alpha < \frac{\Delta r}{R} \tag{F}$$

In addition, where Δr/R is an intensity ratio of amplitude components of a user speech as shown in expression (A). Expression (F) shows that a noise intensity ratio is made less than an intensity ratio of a user speech Δr/R in the microphone unit 1.

In accordance with the above descriptions, in accordance with the microphone unit 1 according to the present embodiment, since an intensity ratio of phase components of a user speech is made less than an intensity ratio of amplitude components (refer to expression (B)), a noise intensity ratio is made less than an intensity ratio of the user speech (refer to expression (F)). Accordingly, the microphone unit 1 according to the present embodiment has an excellent noise-canceling function.

4. METHOD FOR MANUFACTURING THE MICROPHONE UNIT 1

Hereinafter, a method for manufacturing the microphone unit 1 according to the present embodiment will be described. In the microphone unit 1 according to the present embodiment, the microphone unit 1 may be manufactured by utilizing data indicating a correspondence relationship between a value of Δr/λ indicating a percentage of a center-to-center distance Δr between the first through hole 12 and the second through hole 14 to a wavelength λ of a noise, and a noise intensity ratio (an intensity ratio based on phase components of the noise).

An intensity ratio based on phase components of a noise is expressed by the above-described expression (18). Therefore, a decibel value of the intensity ratio based on the phase components of the noise may be expressed as follows:

[Expression 23]

$$20\log\rho(N) = 20\log\left|2\sin\frac{\alpha}{2}\right| \quad (20)$$

Figure 6:
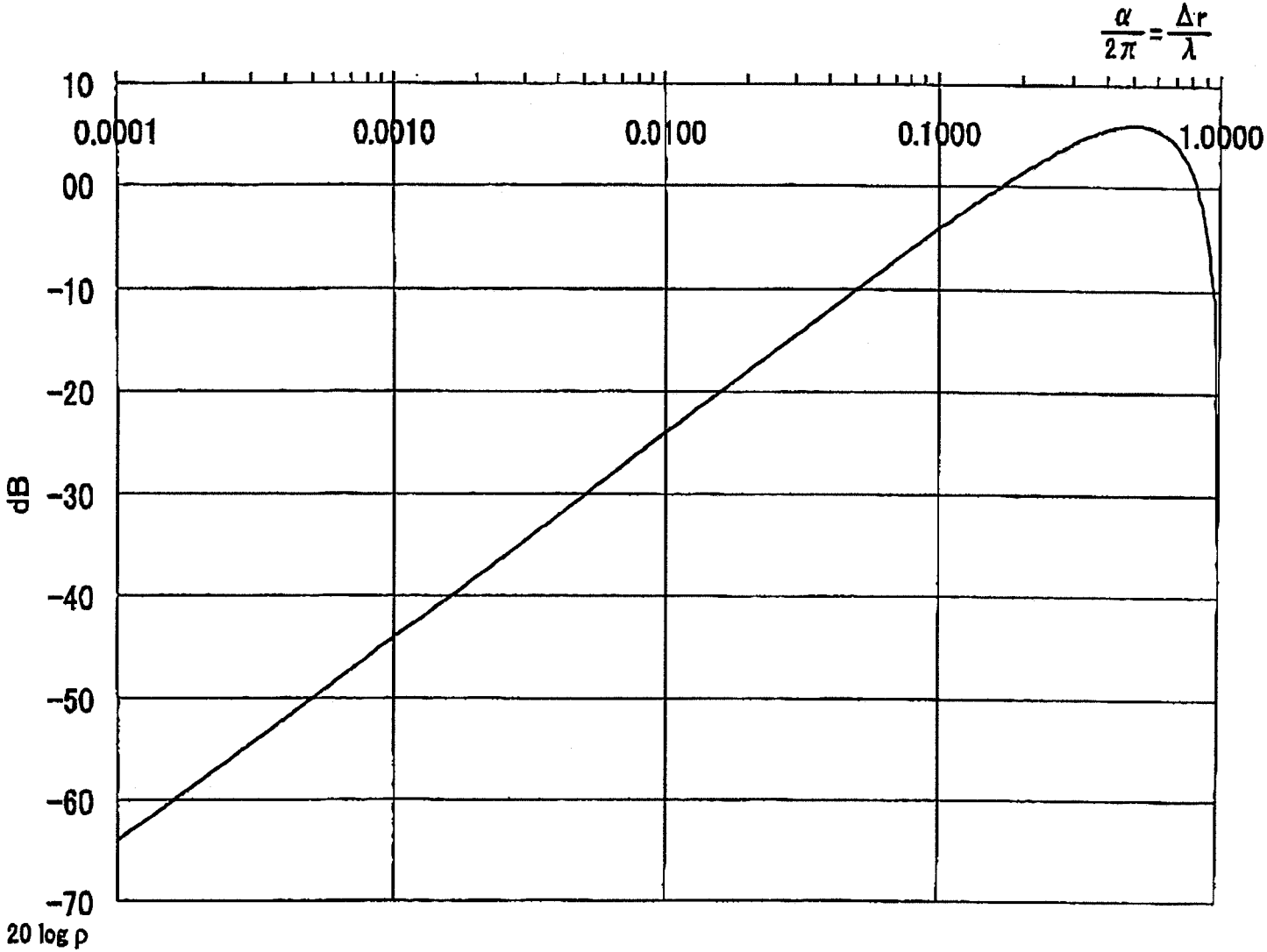
FIG. 6 is a view showing an example of data indicating the correspondence relationship between phase differences and intensity ratios.

Then, when respective values are substituted for $\alpha$ in expression (20), it is possible to clarify the correspondence relationship between a phase difference $\alpha$ and an intensity ratio based on phase components of a noise. FIG. 6 shows an example of data indicating a correspondence relationship between a phase difference and an intensity ratio when $\alpha/2\pi$ is plotted on the abscissa and intensity ratio based on phase components of a noise (decibel values) is plotted on the ordinate.

In addition, as shown in expression (12), a phase difference $\alpha$ may be expressed by a function of $\Delta r/\lambda$ that is a ratio between a distance $\Delta r$ and a wavelength $\lambda$, and the abscissa of FIG. 6 may be considered as $\Delta r/\lambda$. That is, FIG. 6 may be said to be data indicating a correspondence relationship between intensity ratios based on phase components of a noise and $\Delta r/\lambda$.

Figure 7:
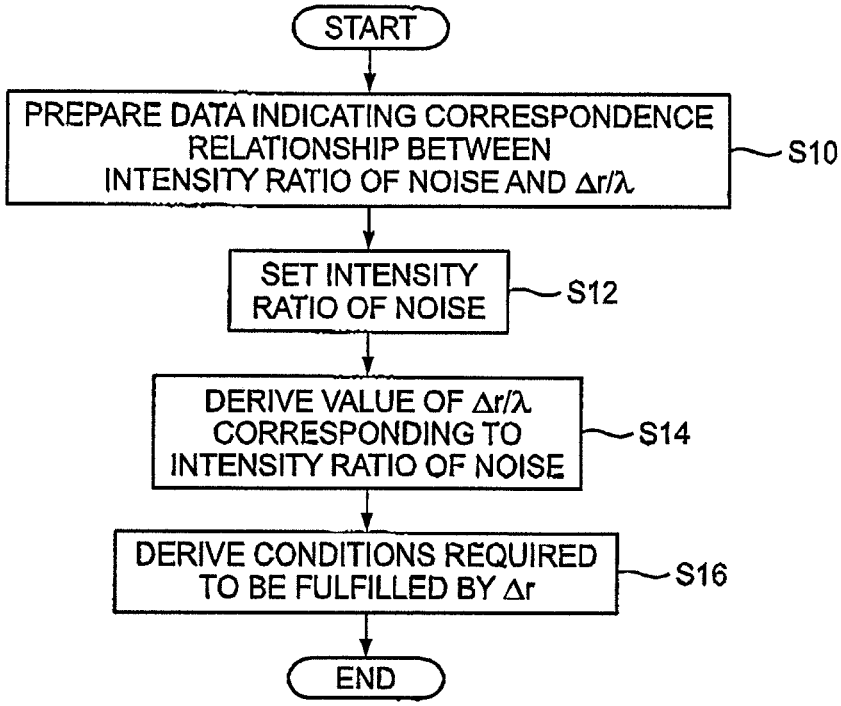
FIG. 7 is a flowchart showing the procedures for manufacturing a microphone unit.

In the present embodiment, the microphone unit 1 is manufactured by utilizing this data. FIG. 7 is a flowchart for explanation of the procedure for manufacturing the microphone unit 1 by utilizing the data.

First, data (refer to FIG. 6) indicating a correspondence relationship between an intensity ratio of a noise (an intensity ratio based on phase components of a noise) and $\Delta r/\lambda$ are prepared (step S10).

Next, intensity ratio of a noise is set (step S12). In addition, in the present embodiment, it is necessary to set the intensity ratio of a noise so as to reduce the intensity ratio of a noise. Therefore, in this step, intensity of a noise is set to 0 decibels or less.

Next, values of $\Delta r/\lambda$ corresponding to the intensity ratios of the noise are derived on the basis of the data (step S14).

Then, conditions required to be fulfilled by $\Delta r$ are derived by substituting a principal noise wavelength for $\lambda$ (step S16).

As a concrete example, the case where the microphone unit 1 is manufactured in which an intensity of a noise deteriorates by 20 decibels in an environment that the principal noise is 1 kHz and its wavelength is 0.347 m, will be considered.

First, a condition for an intensity ratio of a noise to be made 0 decibels or less will be considered. With reference to FIG. 6, it is shown that a value of $\Delta r/\lambda$ needs to be 0.16 or less in order for an intensity ratio of a noise to be 0 decibels or less. That is, it is shown that a value of $\Delta r$ needs to be 55.46 mm or less, and this is a necessary condition for the microphone unit 1 (case 10).

Next, a condition for deteriorating an intensity of a noise of 1 kHz by 20 decibels will be considered. With reference to FIG. 6, it is shown that it is necessary for a value, of $\Delta r/\lambda$ to be 0.015 in order to deteriorate an intensity ratio of a noise by 20 decibels. Then, given that $\lambda$=0.347 m, it is shown that the condition is fulfilled when a value of $\Delta r$ is 5.199 mm or less. That is, when $\Delta r$ is set to approximately 52 mm or less, it is possible to manufacture the microphone unit 1 having a noise-canceling function.

In addition, in the case where the microphone unit 1 according to the present embodiment is utilized for a close-talking type speech input device, an interval between a sound source of a user speech and the microphone unit 1 (the first through hole 12 and the second through hole 14) is usually 5 cm or less. Further, it is possible to set an interval between a sound source of a user speech and the microphone unit 1 (the first through hole 12 and the second through hole 14) by a design of the case in which the microphone unit 1 is housed. Therefore, it is shown that a value of $\Delta r/R$ which is an intensity ratio of a speech of a user is made greater than 0.1 (an intensity ratio of the noise), thereby achieving a noise-canceling function.

In addition, usually, a noise is not limited to a single frequency. However, since a noise at a frequency lower than that of a noise supposed as a principal noise has a wavelength longer than that of the principal noise, a value of $\Delta r/\lambda$ is made small, which may be canceled by this microphone unit 1. Further, the higher the frequency is, the faster the energy of a sound wave is attenuated. Therefore, since a noise at a frequency higher than that of a noise supposed as a principal noise is attenuated faster than the principal noise, the effect on the microphone unit 1 (vibrating membrane 30) may be ignored. With this, the microphone unit 1 according to the present embodiment is capable of achieving an excellent noise-canceling function even in an environment in which there is a noise at a frequency different from that of a noise supposed as a principal noise.

Further, in the present embodiment, as shown from expression (12), noises incident from above the straight line connecting the first through hole 12 and the second through hole 14 are assumed. The noises are noises in which an apparent interval between the first through hole 12 and the second through hole 14 is maximized, and noises between which a phase difference is maximized in a real usage environment. That is, the microphone unit 1 according to the present embodiment is configured to be capable of canceling noises between which a phase difference is maximized. Therefore, in accordance with the microphone unit 1 according to the present embodiment, it is possible to cancel noises incident thereto from all directions.

5. EFFECT

Hereinafter, the effects performed by the microphone unit 1 will be summarized.

As described above, in accordance with the microphone unit 1, it is possible to acquire an electrical signal indicating a speech whose noise components are canceled by merely acquiring an electrical signal indicating vibration of the vibrating membrane 30 (an electrical signal based on vibration of the vibrating membrane 30). That is, it is possible to achieve a noise-canceling function without performing complex analytic arithmetic processing in the microphone unit 1. Therefore, it is possible to provide a high-quality microphone unit capable of performing thorough noise cancellation with a simple configuration. In particular, by setting a center-to-center distance $\Delta r$ between the first through hole 12 and the second through hole 14 to 5.2 mm, or less, it is possible to provide a microphone unit capable of achieving a higher accuracy noise-canceling function.

Further, a center-to-center distance between the first through hole 12 and the second through hole 14 may be set to a distance within a range in which sound pressure in the case where the vibrating membrane 30 is used as a differential microphone does not exceed sound pressure in the case where the vibrating membrane 30 is used as a single microphone with respect to a sound in a frequency band less than or equal to 10 kHz.

The first through hole 12 and the second through hole 14 may be disposed along a traveling direction of a sound (for example, a speech) from a sound source, and a center-to-center distance between the first and second through holes may be set to a distance within a range in which sound pressure in the case where the vibrating membrane 30 is used as a differential microphone does not exceed sound pressure in the case where the vibrating membrane 30 is used as a single microphone with respect to a sound from the traveling direction.

Figure 22:
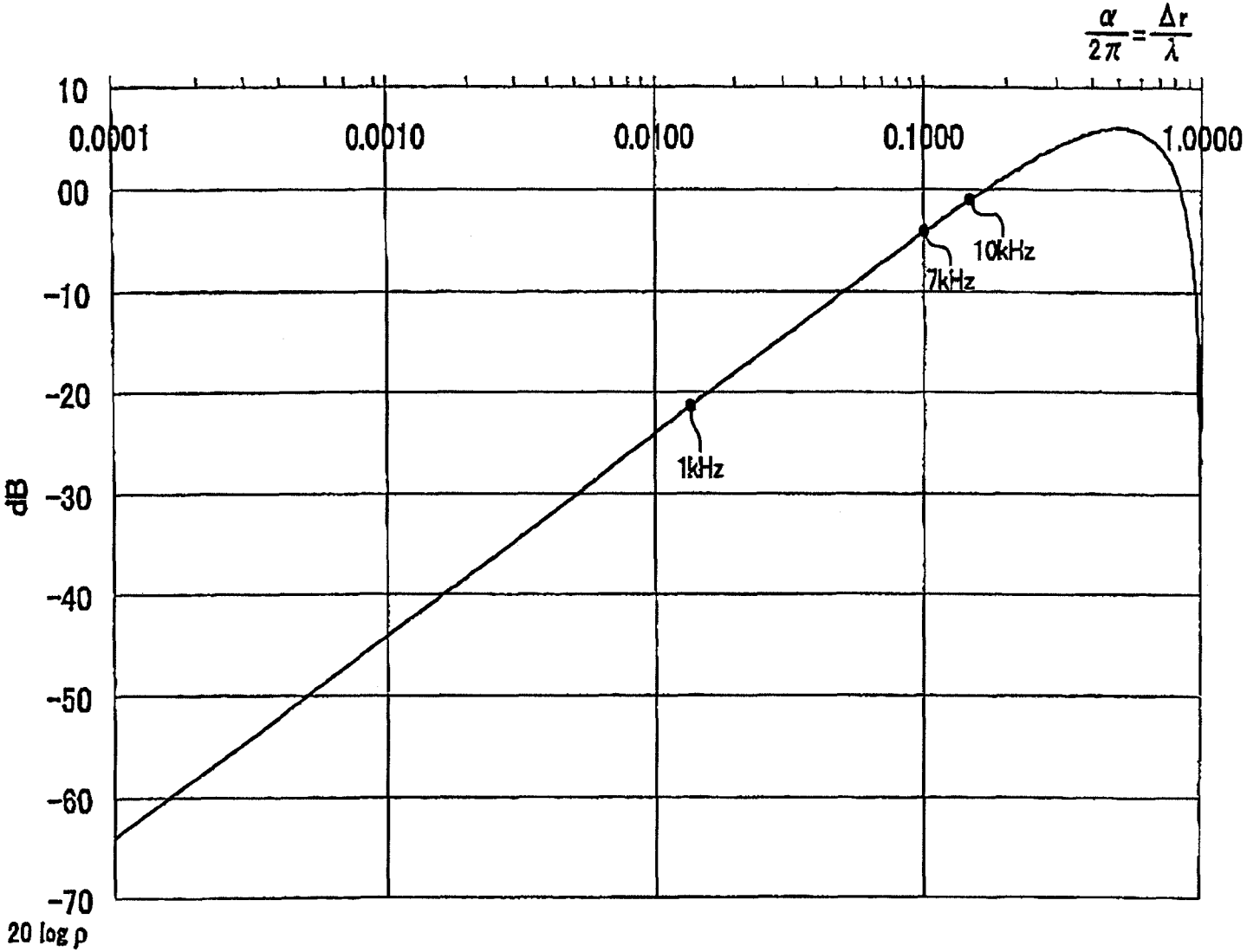
FIG. 22 is a graph for explanation of the relationship of attenuation rates of differential sound pressures in the case where a microphone-to-microphone distance is 5 mm.
Figure 23:
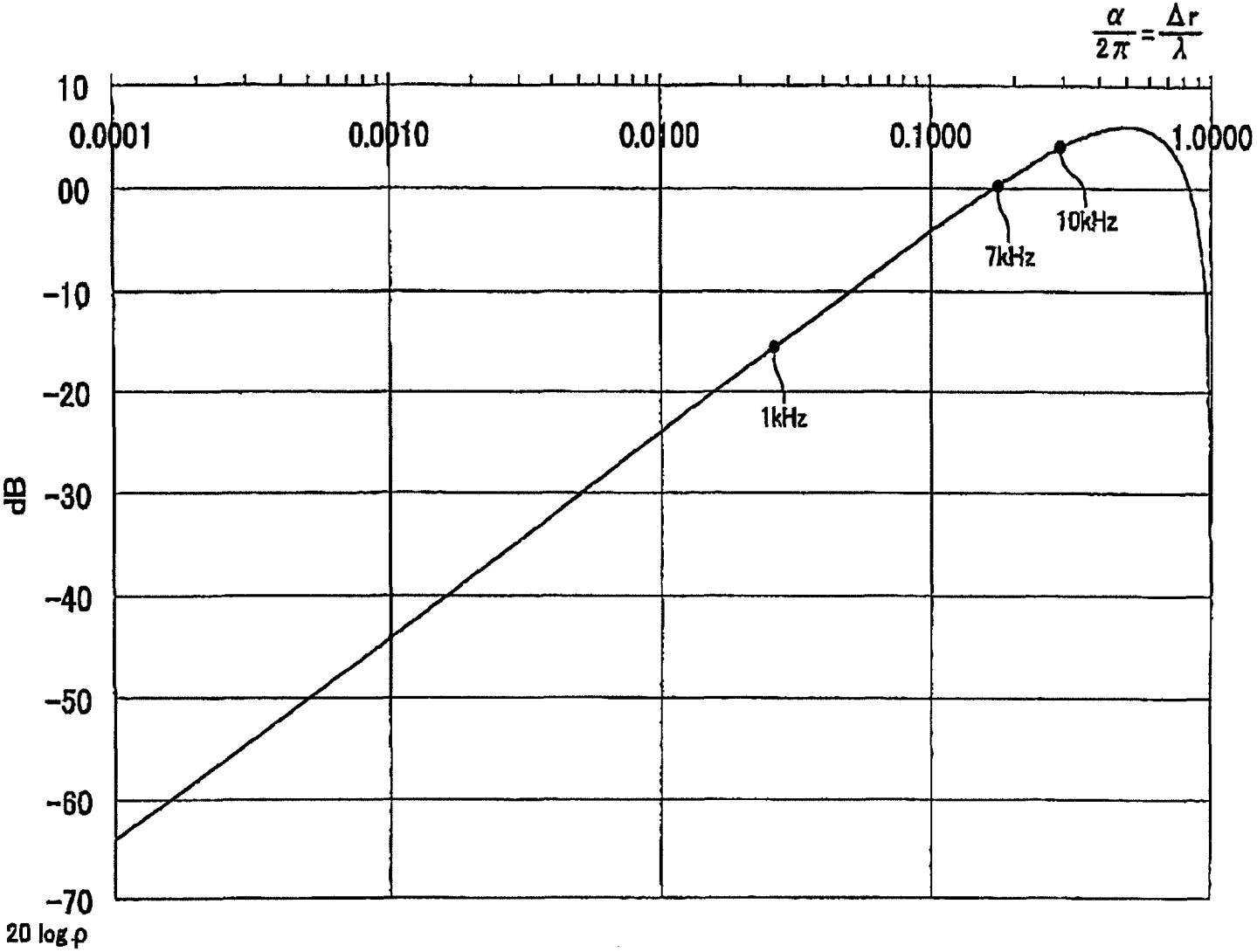
FIG. 23 is a graph for explanation of the relationship of attenuation rates of differential sound pressures in the case where a microphone-to-microphone distance is 10 mm.
Figure 24:
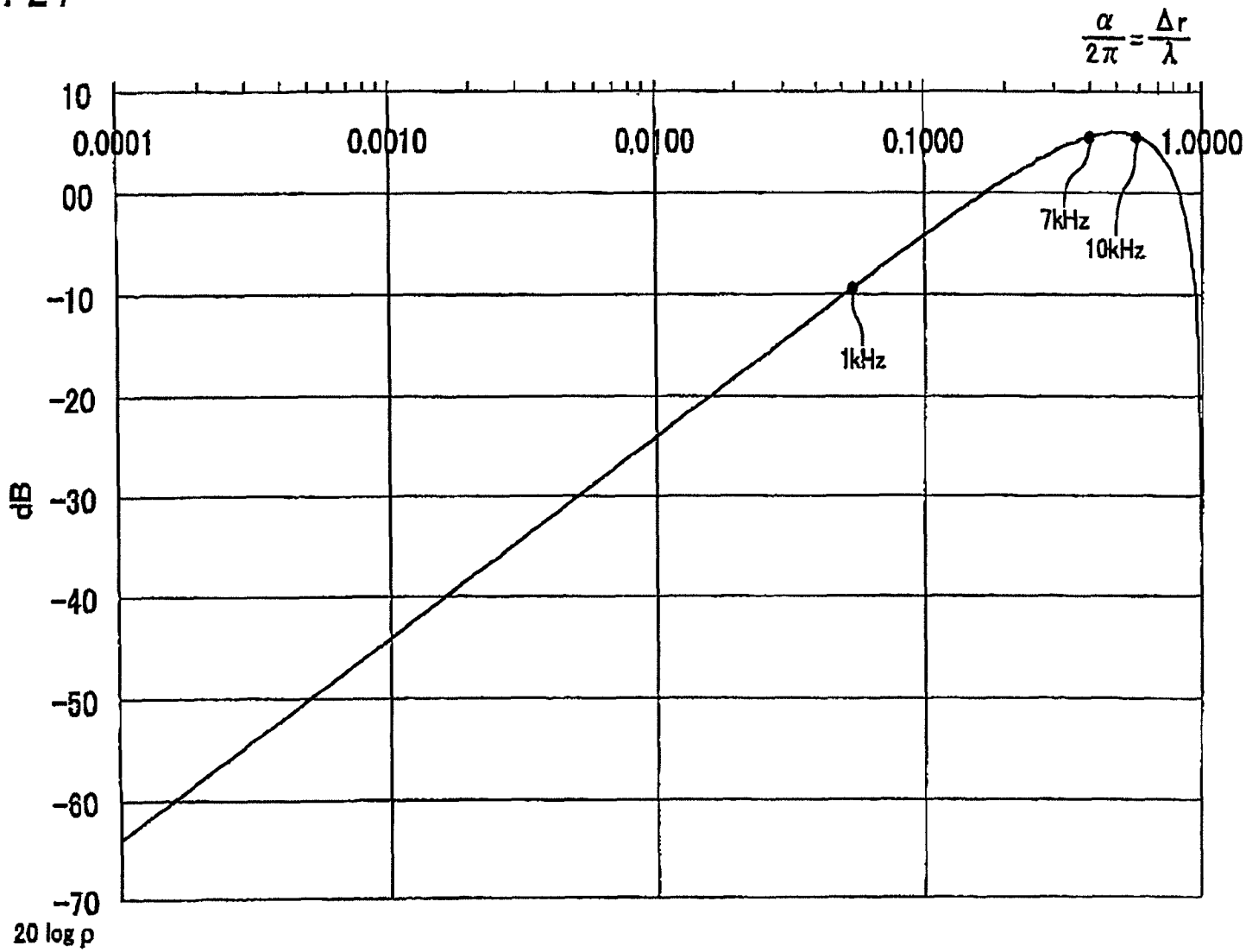
FIG. 24 is a graph for explanation of the relationship of attenuation rates of differential sound pressures in the case where a microphone-to-microphone distance is 20 mm.
Figure 25:
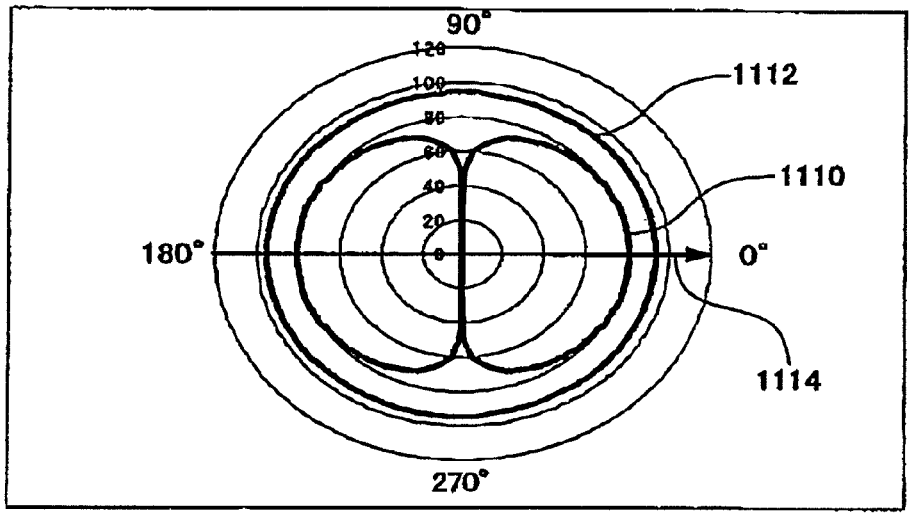
FIG. 25 are views for explanation of the directivities of a differential microphone in the cases where a microphone-to-microphone distance is 5 mm, a frequency band is 1 kHz, and a microphone-to-sound source distance is 2.5 cm and 1 m.
Figure 25:
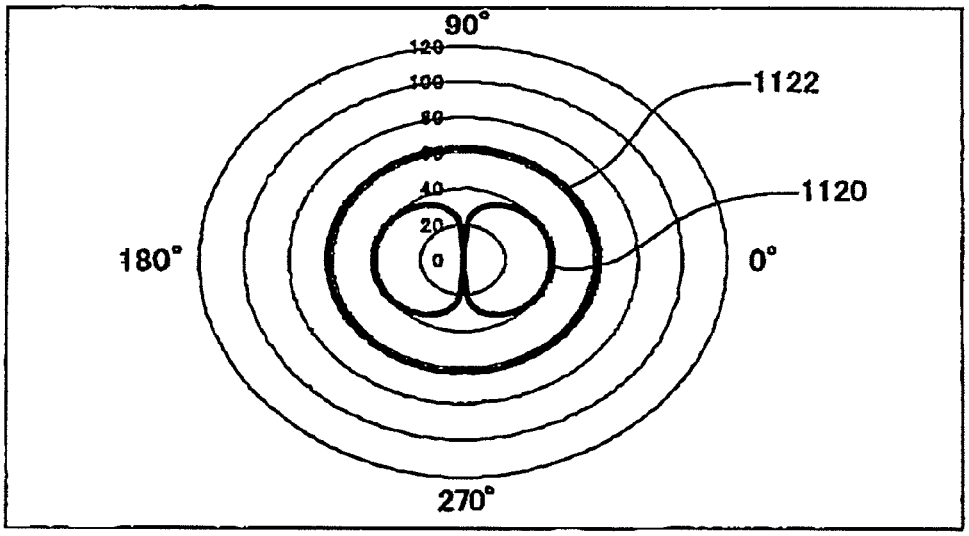
Figure 26:
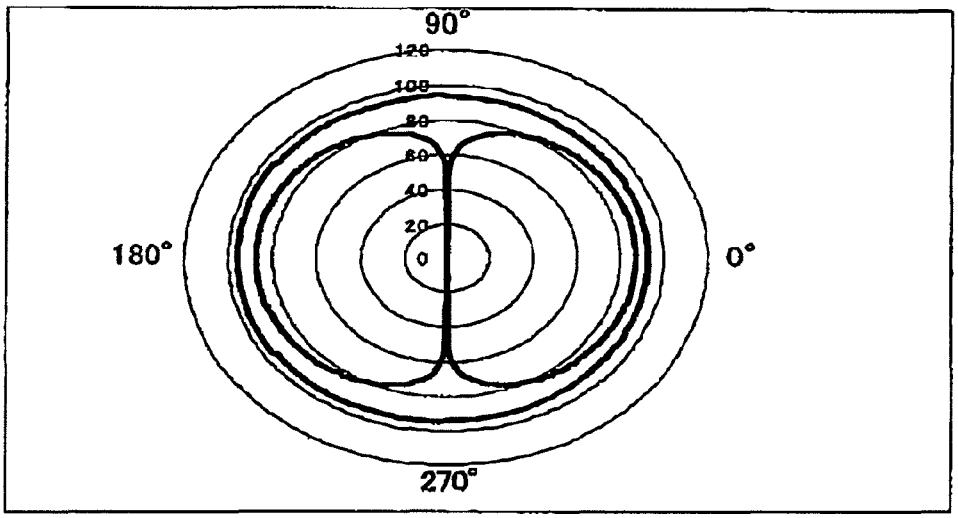
FIG. 26 are views for explanation of the directivities of a differential microphone in the cases where a microphone-to-microphone distance is 10 mm, a frequency band is 1 kHz, and a microphone-to-sound source distance is 2.5 cm and 1 m.
Figure 26:
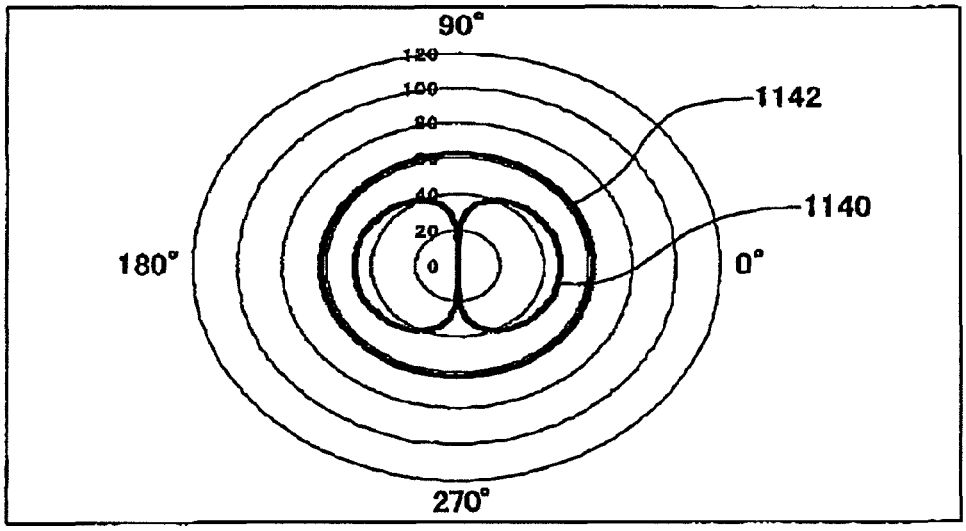
Figure 27:
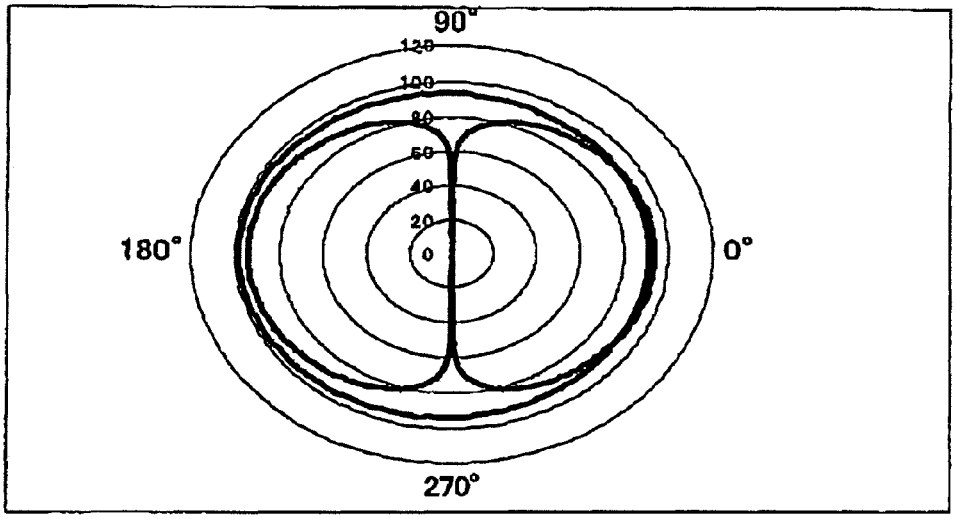
FIG. 27 are views for explanation of the directivities of a differential microphone in the cases where a microphone-to-microphone distance is 20 mm, a frequency band is 1 kHz, and a microphone-to-sound source distance is 2.5 cm and 1 m.
Figure 27:
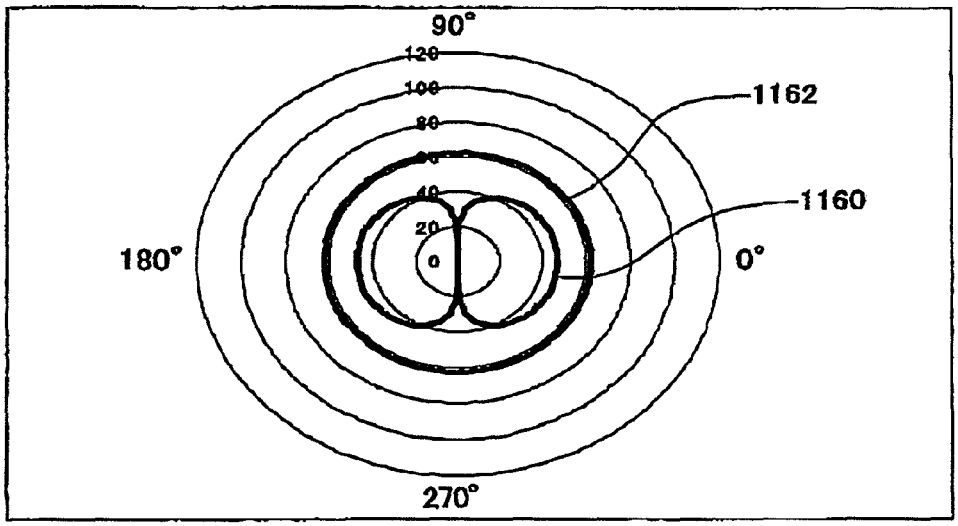
Figure 28:
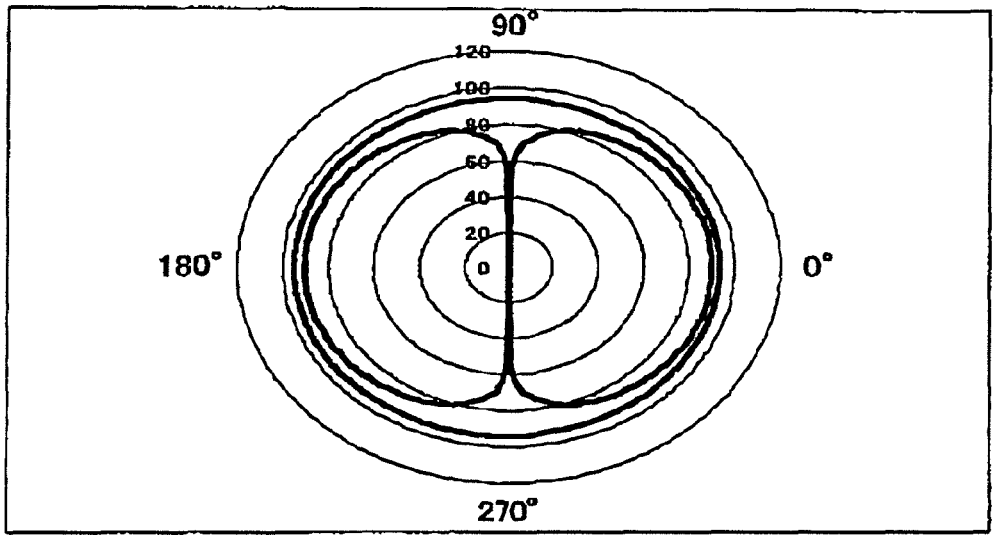
FIG. 28 are views for explanation of the directivities of a differential microphone in the cases where a microphone-to-microphone distance is 5 mm, a frequency band is 7 kHz, and a microphone-to-sound source distance is 2.5 cm and 1 m.
Figure 28:
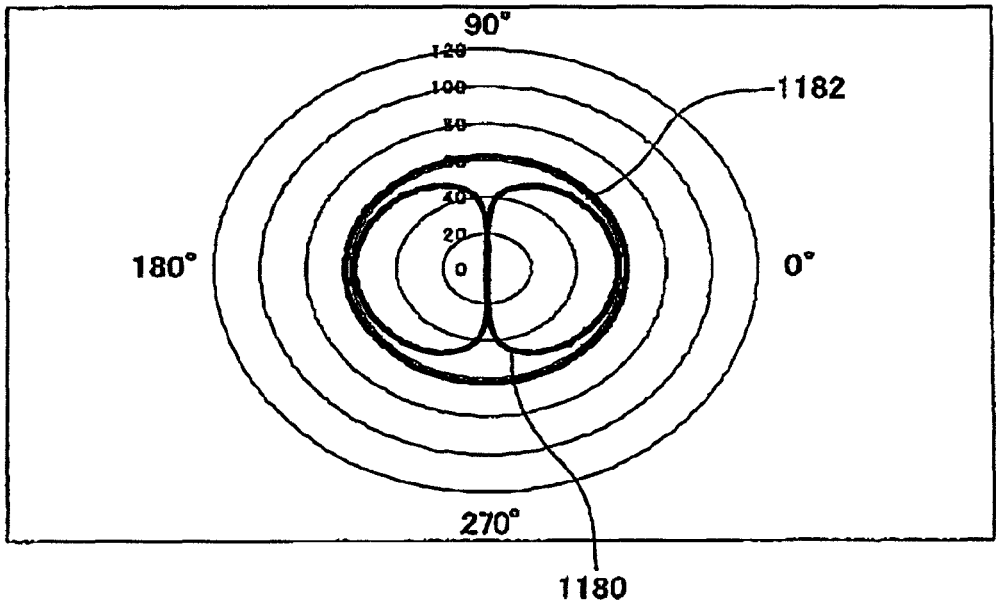
Figure 29:
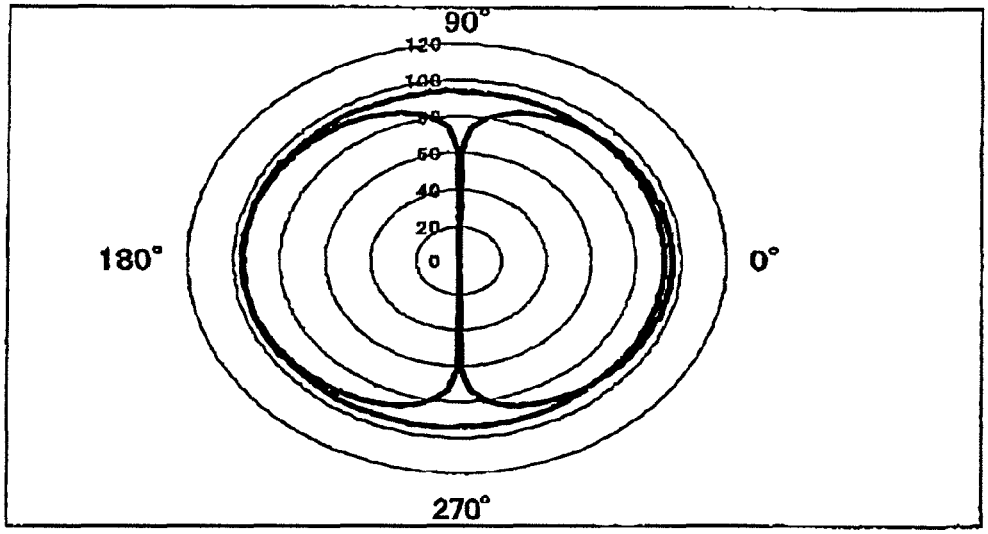
FIG. 29 are views for explanation of the directivities of a differential microphone in the cases where a microphone-to-microphone distance is 10 mm, a frequency band is 7 kHz, and a microphone-to-sound source distance is 2.5 cm and 1 m.
Figure 29:
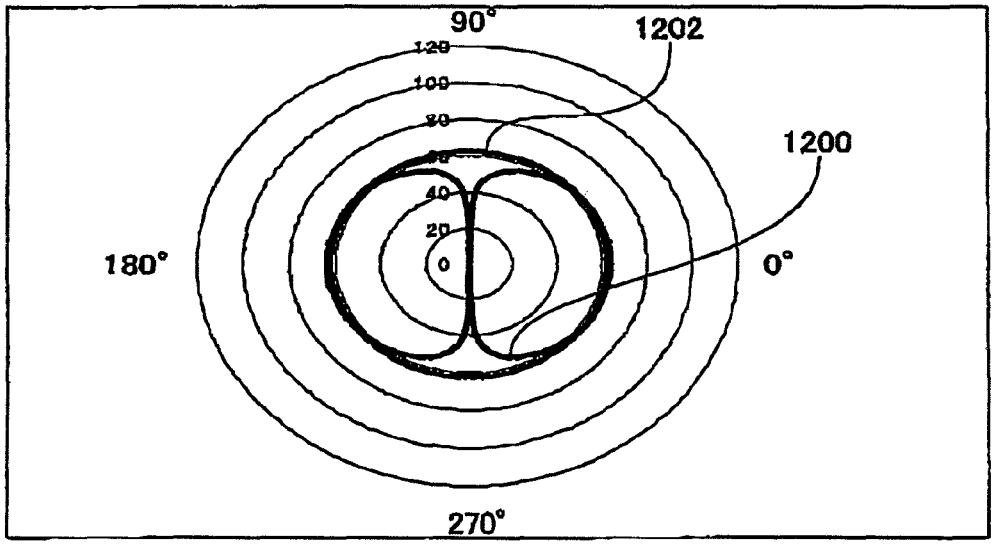
Figure 30:
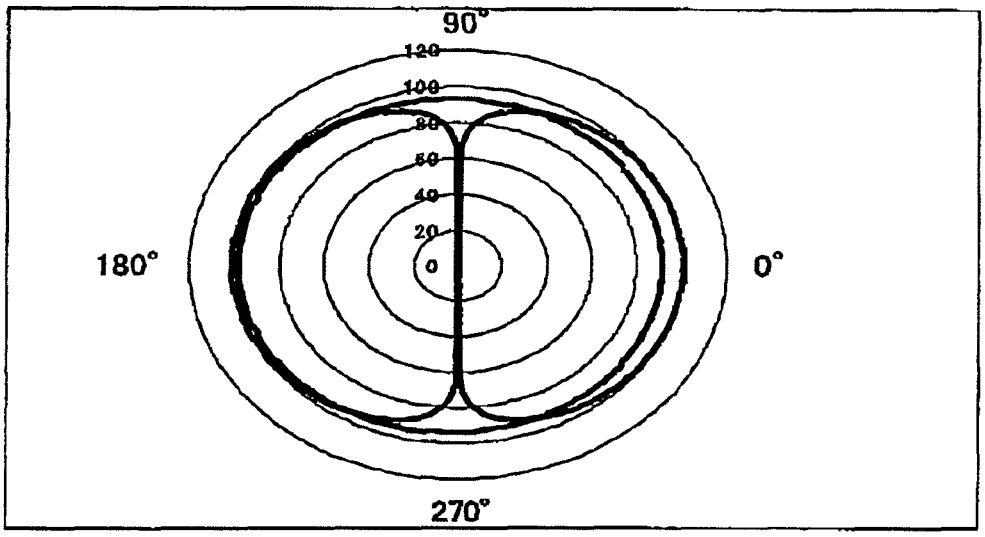
FIG. 30 are views for explanation of the directivities of a differential microphone in the cases where a microphone-to-microphone distance is 20 mm, a frequency band is 7 kHz, and a microphone-to-sound source distance is 2.5 cm and 1 m.
Figure 30:
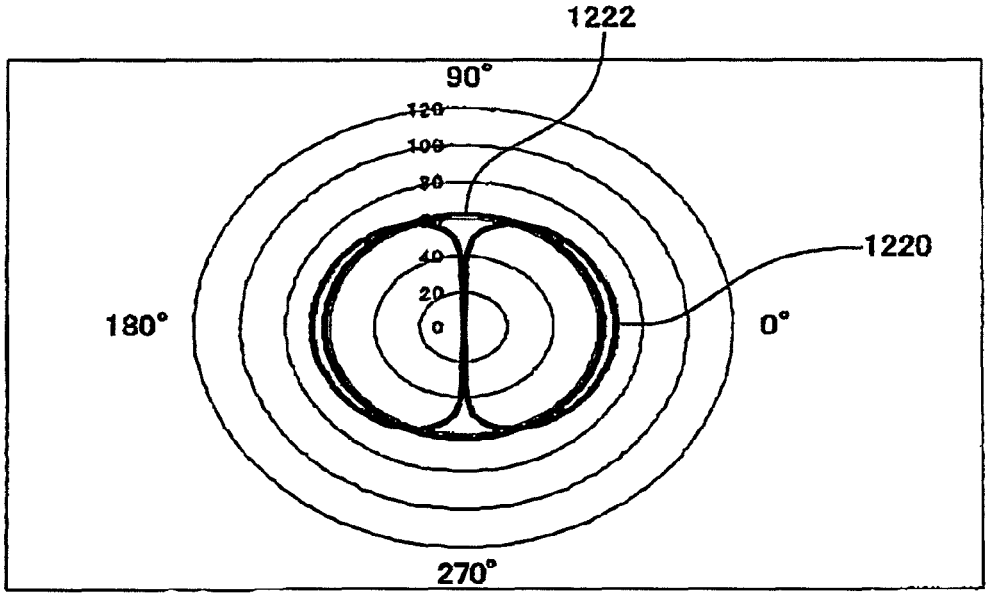
Figure 31:
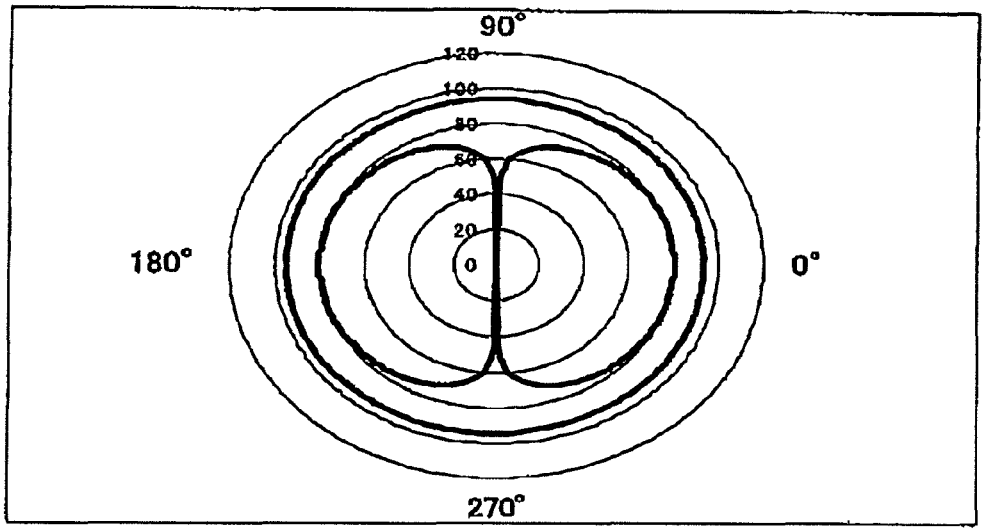
FIG. 31 are views for explanation of the directivities of a differential microphone in the cases where a microphone-to-microphone distance is 5 mm, a frequency band is 300 Hz, and a microphone-to-sound source distance is 2.5 cm and 1 m.
Figure 31:
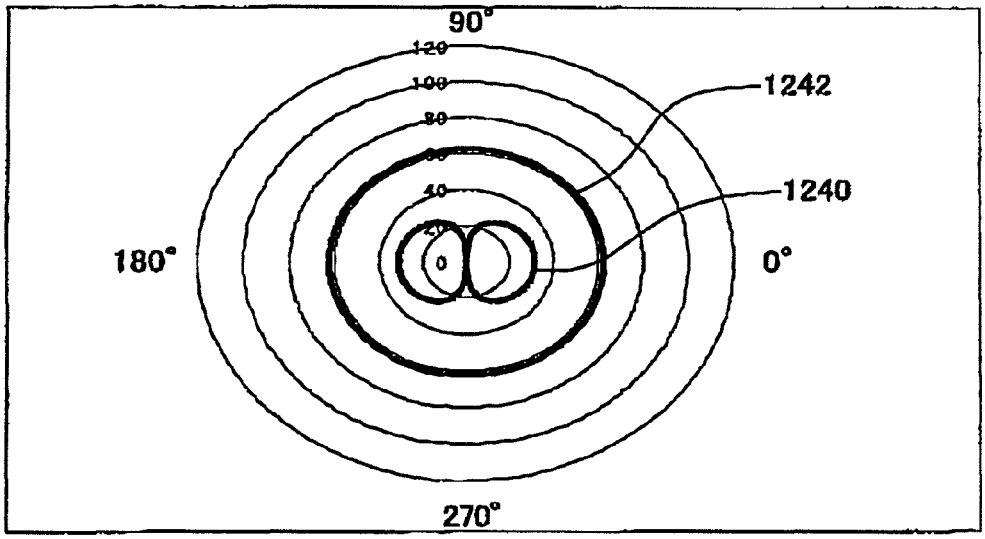

FIGS. 22 to 24 are graphs for explanation of the relationships between microphone-to-microphone distances and differential sound pressures. Then, FIG. 22 shows the distribution of the differential sound pressures when detecting sounds at frequencies of 1 kHz, 7 kHz, and 10 kHz with the differential microphone in the case where the microphone-to-microphone distance ($\Delta r$) is 5 mm. Further, FIG. 23 shows the distribution of the differential sound pressures when detecting sounds at frequencies of 1 kHz, 7 kHz, and 10 kHz with the differential microphone in the case where the microphone-to-microphone distance ($\Delta r$) is 10 mm. Further, FIG. 24 shows the distribution of the differential sound pressures when detecting sounds at frequencies of 1 kHz, 7 kHz, and 10 kHz with the differential microphone in the case where the microphone-to-microphone distance ($\Delta r$) is 20 mm.

In FIGS. 22 to 24, the abscissas are $\Delta r/\lambda$ and the ordinates are differential sound pressures. The differential sound pressure is sound pressure in the case where the vibrating membrane is used as a differential microphone, and a level at which sound pressure in the case where the microphone composing the differential microphone is used as a single microphone is made equal to the level of the differential sound pressure is set to 0 decibels.

That is, the graphs of FIGS. 22 to 24 show the transitions of the differential sound pressures corresponding to $\Delta r/\lambda$, and the area greater than 0 decibels on the ordinates may be considered to be large in delay distortion (noise).

As shown in FIG. 22, in the case where the microphone-to-microphone distance is 5 mm, the differential sound pressures of all the sounds at frequencies of 1 kHz, 7 kHz, and 10 kHz are less than or equal to 0 decibels.

Further, as shown in FIG. 23, in the case where the microphone-to-microphone distance is 10 mm, the differential sound pressures of the sounds at frequencies of 1 kHz and 7 kHz are less than or equal to 0 decibels, but the differential sound pressure of the sound at a frequency of 10 kHz is made greater than or equal to 0 decibels, which results in large delay distortion (noise).

Further, as shown in FIG. 24, in the case where the microphone-to-microphone distance is 20 mm, the differential sound pressure of the sound at a frequency of 1 kHz is less than or equal to 0 decibels, but the differential sound pressures of the sounds at frequencies of 7 kHz and 10 kHz are made greater than or equal to 0 decibels, which results in large delay distortion (noise).

Accordingly, by setting the microphone-to-microphone distance to approximately 5 mm to 6 mm (in more detail, 5.2 mm or less), it is possible to realize a microphone which faithfully extracts a speaker's speech up to a frequency band of 10 kHz, with a high depression effect for a distant noise.

In the present embodiment, by setting a center-to-center distance between the first through hole 12 and the second through hole 14 to approximately 5 mm to 6 mm (in more detail, 5.2 mm or less), it is possible to realize a microphone which faithfully extracts a speaker's speech up to a frequency band of 10 kHz, with a high depression effect for a distant noise.

Further, in the microphone unit 1, it is possible to design the case 10 (the positions of the first through hole 12 and the second through hole 14) so as to be capable of canceling noises incident such that a noise intensity ratio based on its phase difference is maximized. Therefore, in accordance with the microphone unit 1, it is possible to cancel noises incident thereto from all directions. That is, in accordance with the present invention, it is possible to provide a microphone unit capable of canceling noises incident thereto from all directions.

FIGS. 25(A) and 25(B) to FIGS. 31(A) and 31(B) are views for explanation of the directivities of a differential microphone in each case of the frequency bands, the microphone-to-microphone distances, and the microphone-to-sound source distances.

FIGS. 25(A) and 25(B) are views showing the directivities of the differential microphone in the case where the frequency band of the sound source is 1 kHz, the microphone-to-microphone distance is 5 mm, and the microphone-to-sound source distances are respectively 2.5 cm (corresponding to a distance from the speaker's mouth to the close-talking type microphone) and 1 m (corresponding to a distant noise).

Reference numeral 1110 is a graph indicating the sensitivity (differential sound pressure) of the differential microphone to all directions, and shows the directional characteristics of the differential microphone. Further, reference numeral 1112 is a graph indicating the sensitivity (sound pressure) to all directions when the differential microphone is used as a single microphone, and shows the directional characteristics of the single microphone.

Reference numeral 1114 indicates a direction of a straight line connecting the both microphones in the case where the differential microphone is composed of two microphones, or a direction of a straight line connecting the first through hole and the second through hole through which sound waves are made to reach the both surfaces of the microphone in the case where the differential microphone is realized by one microphone (0 degrees to 180 degrees, two microphones M1 and M2 composing the differential microphone or the first through hole and the second through hole are placed on this straight line). The direction of this straight line is 0 degrees and 180 degrees, and the direction perpendicular to the direction of this straight line is 90 degrees and 270 degrees.

As shown by reference numerals 1112 and 1122, the single microphone detects sounds uniformly from all directions, and has no directivity. Further, the farther the sound source is, the more the sound pressures to be acquired are attenuated.

As shown by reference numerals 1110 and 1120, the differential microphone deteriorates in sensitivity to a certain extent in the directions of 90 degrees and 270 degrees, but has the directivity substantially uniform in all directions. Further, sound pressures to be acquired are further attenuated than those by the single microphone, and in the same way as the single microphone, the farther the sound source is, the more the sound pressures to be acquired are attenuated.

As shown in FIG. 25(B), in the case where the frequency band of the sound source is 1 kHz, and the microphone-to-microphone distance is 5 mm, an area surrounded by the graph 1120 of the differential sound pressures indicating the directivity of the differential microphone is internally contained in an area surrounded by the graph 1122 indicating the directivity of the single microphone, which makes it possible to say that the differential microphone is excellent in a depression effect for a distant noise as compared with the single microphone.

FIGS. 26(A) and 26(B) are views for explanation of the directivities of the differential microphone in the case where the frequency band of the sound source is 1 kHz, the microphone-to-microphone distance is 10 mm, and the microphone-to-sound source distances are respectively 2.5 cm and 1 m. In such a case as well, as shown in FIG. 26(B), an area surrounded by the graph 1140 indicating the directivity of the differential microphone is internally contained in an area surrounded by the graph 1142 indicating the directivity of the single microphone, which makes it possible to say that the differential microphone is excellent in a depression effect for a distant noise as compared with the single microphone.

FIGS. 27(A) and 27(B) are views showing the directivities of the differential microphone in the case where the frequency band of the sound source is 1 kHz, the microphone-to-microphone distance is 20 mm, and the microphone-to-sound source distances are respectively 2.5 cm and 1 m. In such a case as well, as shown in FIG. 27(B), an area surrounded by the graph 1160 indicating the directivity of the differential microphone is internally contained in an area surrounded by the graph 1162 indicating the directivity of the single microphone, which makes it possible to say that the differential microphone is excellent in a depression effect for a distant noise as compared with the single microphone.

FIGS. 28(A) and 28(B) are views showing the directivities of the differential microphone in the case where the frequency band of the sound source is 7 kHz, the microphone-to-microphone distance is 5 mm, and the microphone-to-sound source distances are respectively 2.5 cm and 1 m. In such a case as well, as shown in FIG. 28(B), an area surrounded by the graph 1180 indicating the directivity of the differential microphone is internally contained in an area surrounded by the graph 1182 indicating the directivity of the single microphone, which makes it possible to say that the differential microphone is excellent in a depression effect for a distant noise as compared with the single microphone.

FIGS. 29(A) and 29(B) are views showing the directivities of the differential microphone in the case where the frequency band of the sound source is 7 kHz, the microphone-to-microphone distance is 10 mm, and the microphone-to-sound source distances are respectively 2.5 cm and 1 m. In such a case, as shown in FIG. 29(B), an area surrounded by the graph 1200 indicating the directivity of the differential microphone is not internally contained in an area surrounded by the graph 1202 indicating the directivity of the single microphone, which makes it hard to say that the differential microphone is excellent in a depression effect for a distant noise as compared with the single microphone.

FIGS. 30(A) and 30(B) are views showing the directivities of the differential microphone in the case where the frequency band of the sound source is 7 kHz, the microphone-to-microphone distance is 20 mm, and the microphone-to-sound source distances are respectively 2.5 cm and 1 m. In such a case as well, as shown in FIG. 30(B), an area surrounded by the graph 1220 indicating the directivity of the differential microphone is not internally contained in an area surrounded by the graph 1222 indicating the directivity of the single microphone, which makes it hard to say that the differential microphone is excellent in a depression effect for a distant noise as compared with the single microphone.

FIGS. 31(A) and 31(B) are views showing the directivities of the differential microphone in the case where the frequency band of the sound source is 300 Hz, the microphone-to-microphone distance is 5 mm, and the microphone-to-sound source distances are respectively 2.5 cm and 1 m. In such a case, as shown in FIG. 31(B), an area surrounded by the graph 1240 indicating the directivity of the differential microphone is internally contained in an area surrounded by the graph 1242 indicating the directivity of the single microphone, which makes it possible to say that the differential microphone is excellent in a depression effect for a distant noise as compared with the single microphone.

Figure 32:
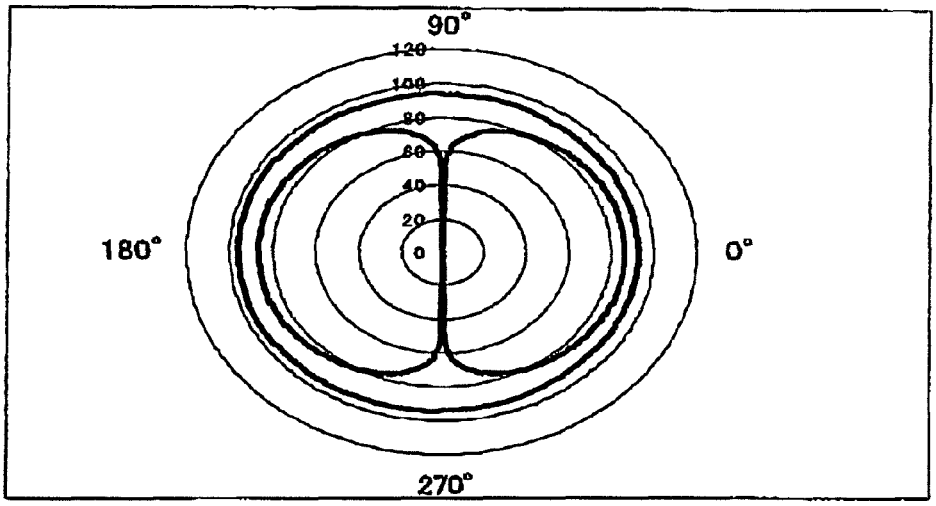
FIG. 32 are views for explanation of the directivities of a differential microphone in the cases where a microphone-to-microphone distance is 10 mm, a frequency band is 300 Hz, and a microphone-to-sound source distance is 2.5 cm and 1 m.
Figure 32:
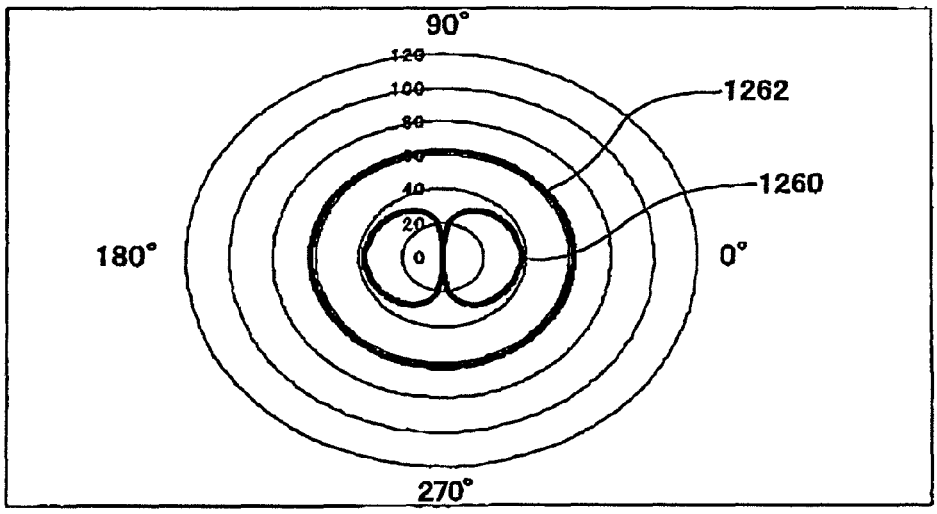

FIGS. 32(A) and 32(B) are views showing the directivities of the differential microphone in the case where the frequency band of the sound source is 300 Hz, a microphone-to-microphone distance is 10 mm, and the microphone-to-sound source distances are respectively 2.5 cm and 1 m. In such a case as well, as shown in FIG. 32(B), an area surrounded by the graph 1260 indicating the directivity of the differential microphone is internally contained in an area surrounded by the graph 1262 indicating the directivity of the single microphone, which makes it possible to say that the differential microphone is excellent in a depression effect for a distant noise as compared with the single microphone.

Figure 33:
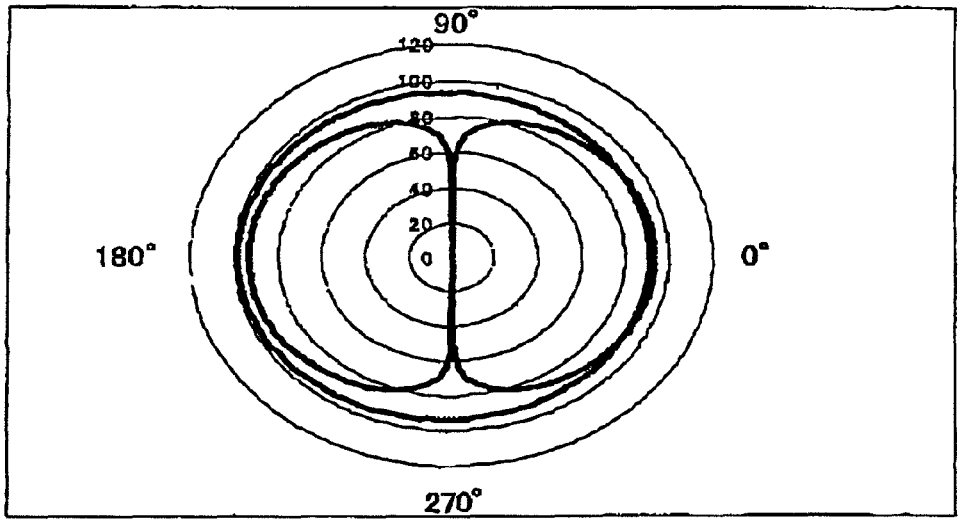
FIG. 33 are views for explanation of the directivities of a differential microphone in the cases where a microphone-to-microphone distance is 20 mm, a frequency band is 300 Hz, and a microphone-to-sound source distance is 2.5 cm and 1 m.
Figure 33:
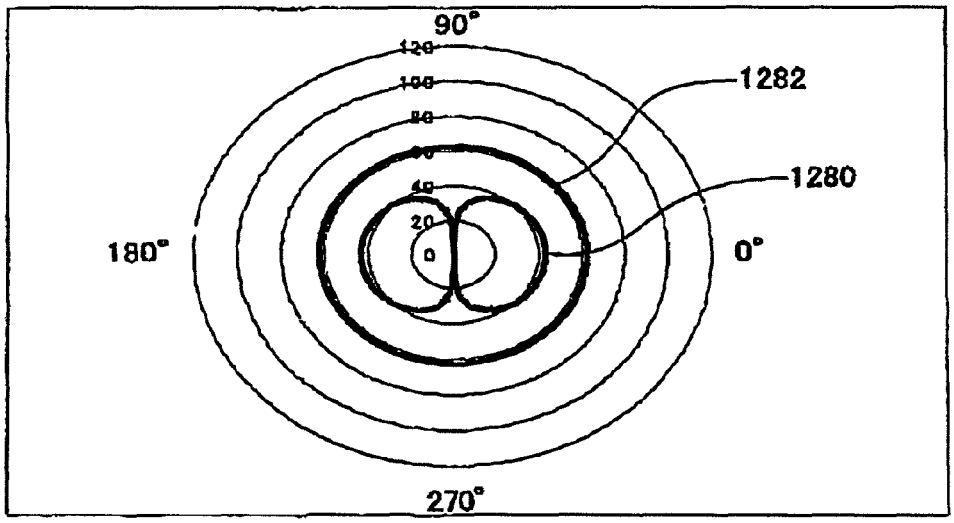

FIGS. 33(A) and 33(B) are views showing the directivities of the differential microphone in the case where the frequency band of the sound source is 300 Hz, the microphone-to-microphone distance is 20 mm, and the microphone-to-sound source distances are respectively 2.5 cm and 1 m. In such a case as well, as shown in FIG. 33(B), an area surrounded by the graph 1280 indicating the directivity of the differential microphone is internally contained in an area surrounded by the graph 1282 indicating the directivity of the single microphone, which makes it possible to say that the differential microphone is excellent in a depression effect for a distant noise as compared with the single microphone.

In the case where the microphone-to-microphone distance is 5 mm, as shown in FIGS. 25(B), 28(B), and 31(B), in any of the cases where the frequency band of the sound is 1 kHz, 7 kHz, or 300 Hz, an area surrounded by the graph indicating the directivity of the differential microphone is internally contained in an area surrounded by the graph indicating the directivity of the single microphone. That is, it is possible to say that the differential microphone is excellent in a depression effect for a distant noise as compared with the single microphone in a band in which the frequency band of the sound is 7 kHz or less in the case where the microphone-to-microphone distance is 5 mm.

However, in the case where the microphone-to-microphone distance is 10 mm, as shown in FIGS. 26(B), 29(B), and 32(B), in the case where the frequency band of the sound is 7 kHz, an area surrounded by the graph indicating the directivity of the differential microphone is not internally contained in an area surrounded by the graph indicating the directivity of the single microphone. That is, it is hard to say that the differential microphone is excellent in a depression effect for a distant noise as compared with the single microphone in a band in which the frequency band of the sound is around 7 kHz in the case where the microphone-to-microphone distance is 10 mm.

Further, in the case where the microphone-to-microphone distance is 20 mm, as shown in FIGS. 27(B), 30(B), and 33(B), in the case where the frequency band of the sound is 7 kHz, an area surrounded by the graph indicating the directivity of the differential microphone is not internally contained in an area surrounded by the graph indicating the directivity of the single microphone. That is, it is hard to say that the differential microphone is excellent in a depression effect for a distant noise as compared with the single microphone in a band in which the frequency band of the sound is around 7 kHz in the case where the microphone-to-microphone distance is 20 mm.

Accordingly, by setting a microphone-to-microphone distance of the differential microphone to approximately 5 mm to 6 mm (in more detail, 5.2 mm or less), it is possible to say that the differential microphone has a higher depression effect for a distant noise from all directions as compared with the single microphone with respect to the sound in a band of 7 kHz or less, independent of the directivity.

In addition, in the case where the differential microphone is realized by one microphone, it is possible to say the same for a distance between the first through hole and the second through hole through which sound waves are made to reach the both surfaces of the microphone. Accordingly, in the present embodiment, by setting a center-to-center distance between the first through hole 12 and the second through hole 14 to approximately 5 mm to 6 mm (in more detail, 5.2 mm or less), it is possible to realize a microphone unit capable of depressing distant noises from all directions independent of the directivity with respect to a sound of 7 kHz or less.

In addition, in accordance with the microphone unit 1, it is possible to cancel user speech components incident to the vibrating membrane 30 (the first surface 35 and the second surface 37) after being reflected by a wall or the like. Specifically, since a user speech reflected by a wall or the like is incident to the microphone unit 1 after propagating a long distance, the user speech may be regarded as a speech generated from a sound source existing farther from a usual user speech, and since the energy of the user speech is greatly lost by the reflection, the sound pressures are not greatly attenuated between the first through hole 12 and the second through hole 14 in the same way as the noise components. Therefore, in accordance with the microphone unit 1, the user speech components incident after being reflected by a wall or the like as well are canceled in the same way as noises (as a type of noise).

Then, by utilizing the microphone unit 1, it is possible to acquire a signal indicating a user speech with no noise contained. Therefore, by utilizing the microphone unit 1, it is possible to achieve highly accurate speech recognition and speech authentication, and command generation processing.

6. SPEECH INPUT DEVICE

Next, a speech input device 2 having the microphone unit 1 will be described.

(1) Configuration of the Speech Input Device 2

Figure 8:
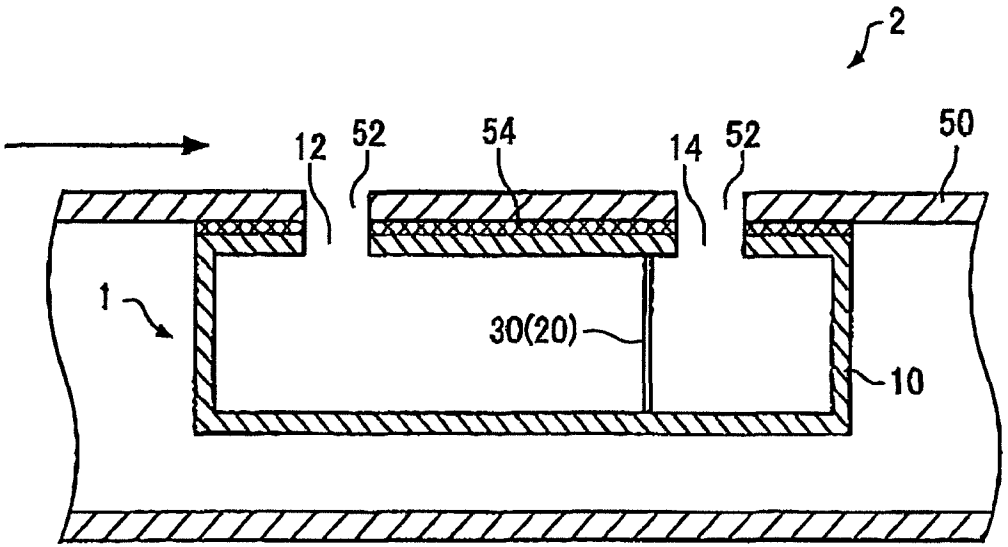
FIG. 8 is a view for explanation of a speech input device.
Figure 9:
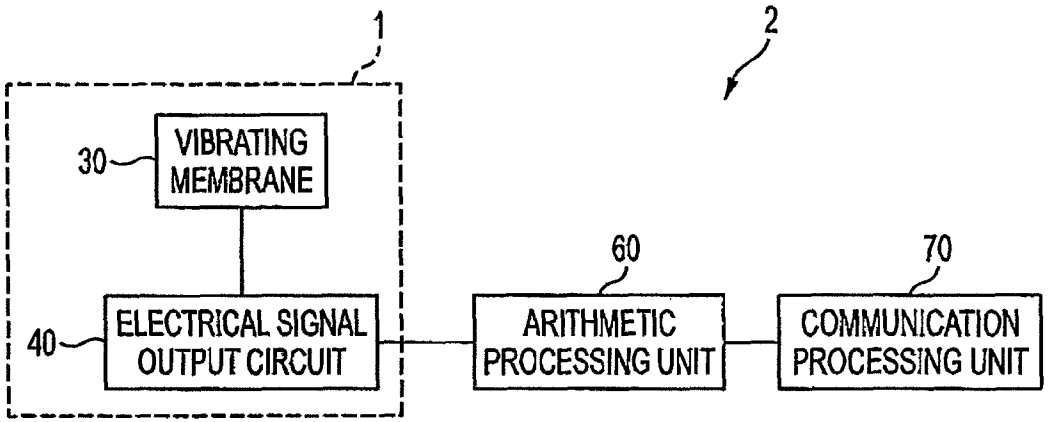
FIG. 9 is a view for explanation of a speech input device.

First, the configuration of the speech input device 2 will be described. FIGS. 8 and 9 are views for explanation of the configuration of the speech input device 2. In addition, the speech input device 2 which will be described hereinafter is a close-talking type speech input device, and may be applied to, for example, speech communication devices such as mobile telephones and transceivers, information processing systems (speech authentication, systems, speech recognition systems, command generation systems, electronic dictionaries, translation machines, speech input method remote controllers, and the like) utilizing a technology of analyzing an input speech, recording devices, amplification systems (loudspeakers), microphone systems, and the like.

FIG. 8 is a view for explanation of the configuration of the speech input device 2. The arrow shown at the upper left of FIG. 8 indicates an input direction of a user speech.

The speech input device 2 has a case 50. The case 50 is a member forming the outer shape of the speech input device 2. A basic position may be set for the case 50, thereby it is possible to regulate a traveling route of a user speech. Apertures 52 for receiving a speech from a user may be formed in the case 50.

In the speech input device 2, the microphone unit 1 is installed inside the case 50. At this time, the microphone unit 1 may be installed in the case 50 such that the first through hole 12 and the second through hole 14 respectively overlap with the apertures 52. With this, the internal space of the microphone unit 1 is communicated with the outside through the first through hole 12, the second through hole 14, and the apertures 52 overlapped with these through holes. The microphone unit 1 may be installed in the case 50 via an elastic body 54. With this, vibration of the case 50 of the speech input device 2 is hard to transmit to the case 10, which makes it possible to accurately operate the microphone unit 1.

The microphone unit 1 may be installed in the case 50 such that the first through hole 12 and the second through hole 14 are disposed out of alignment along the traveling direction of a user speech. Then, a through hole disposed at the upstream side of the traveling route of a user speech may be set as the first through hole 12, and a through hole disposed at the downstream side thereof may be set as the second through hole 14. Provided that the microphone unit 1 in which the vibrating membrane 30 is disposed beside the second through hole 14 is disposed as described above, it is possible to make a user speech incident simultaneously to the both surfaces of the vibrating membrane 30 (the first surface 35 and the second surface 37). Specifically, since a distance from the center of the first through hole 12 to the first surface 35 is substantially equal to a distance from the first through hole 12 to the second through hole 14 in the microphone unit 1, a time required for a user speech passed through the first through hole 12 to be incident to the first surface 35 is made substantially equal to a time required for a user sound wave passed above the first through hole 12 to be incident to the second surface 37 via the second through hole 14. That is, a time required for a speech vocalized by a user to be incident to the first surface 35 is made substantially equal to a time required for the speech vocalized by the user to be incident to the second surface 37. Therefore, it is possible to make the user speech incident simultaneously to the first surface 35 and the second surface 37, and it is possible to vibrate the vibrating membrane 30 so as not to generate a noise due to phase shifting. In other words, it is shown that, since $\alpha=0$ and $\mathrm{Sin}\,\omega t-\mathrm{Sin}(\omega t-\alpha)=0$ in expression (8) described above, the term of $\Delta r/R \sin \omega t$ (amplitude components) is extracted. Therefore, even in the case where a user speech of approximately 7 kHz which is a high frequency band as a human speech is incident thereto, an effect of phase shifting between sound pressure incident to the first surface 35 and sound pressure input to the second surface 37 is ignorable, and it is possible to acquire an electrical signal accurately indicating the user speech.

(2) Functions of the Speech Input Device 2

Next, the functions of the speech input device 2 will be described with reference to FIG. 9. In addition, FIG. 9 is a block diagram for explanation of the functions of the speech input device 2.

The speech input device 2 has the microphone unit 1. The microphone unit 1 outputs an electrical signal generated on the basis of vibration of the vibrating membrane 30. In addition, an electrical signal output from the microphone unit 1 is an electrical signal indicating a user speech whose noise components are canceled.

The speech input device 2 may have an arithmetic processing unit 60. The arithmetic processing unit 60 executes various arithmetic processings on the basis of an electrical signal output from the microphone unit 1 (the electrical signal output circuit 40). The arithmetic processing unit 60 may execute analysis processing for an electrical signal. The arithmetic processing unit 60 may execute processing of specifying a person vocalizing a user speech (so-called speech authentication processing) by analyzing an output signal from the microphone unit 1. Or, the arithmetic processing unit 60 may execute processing of specifying the content of a user speech (so-called speech recognition processing) by executing analysis processing for an output signal from the microphone unit 1. The arithmetic processing unit 60 may execute processing of creating various commands on the basis of an output signal from the microphone unit 1. The arithmetic processing unit 60 may execute processing of amplifying an output signal from the microphone unit 1. Further, the arithmetic processing unit 60 may control the operation of a communication processing unit 70 which will be described later. In addition, the arithmetic processing unit 60 may achieve the above-described respective functions by signal processings by CPUs or memories. Or, the arithmetic processing unit 60 may achieve the above-described respective functions by dedicated hardware.

The speech input device 2 may further include the communication processing unit 70. The communication processing unit 70 controls communication between the speech input device 2 and another terminal (a mobile telephone terminal, a host computer, or the like). The communication processing unit 70 may have a function of transmitting a signal (an output signal from the microphone unit 1) to another terminal via a network. The communication processing unit 70 may also have a function of receiving a signal from another terminal via a network. Then, for example, various information processings such as speech recognition processing and speech authentication processing, command generation processing, and data storage processing may be executed by executing analysis processing for an output signal acquired via the communication processing unit 70 by a host computer. That is, the speech input device 2 may compose an information processing system in cooperation with another terminal. In other words, the speech input device 2 may be regarded as an information input terminal structuring the information processing system. Meanwhile, the speech input device 2 may have a configuration without the communication processing unit 70.

In addition, the arithmetic processing unit 60 and the communication processing unit 70 may be disposed as a packaged semiconductor apparatus (integrated circuit apparatus) inside the case 50. Meanwhile, the present invention is not limited thereto. For example, the arithmetic processing unit 60 may be disposed outside the case 50. In the case where the arithmetic processing unit 60 is disposed outside the case 50, the arithmetic processing unit 60 may acquire a differential signal via the communication processing unit 70.

In addition, the speech input device 2 may further include a display device such as a display panel, or a speech output device such as a loudspeaker. Further, the speech input device 2 may further include operation keys for inputting operational information.

The speech input device 2 may have the above-described configuration. This speech input device 2 utilizes the microphone unit 1. Therefore, the speech input device 2 is capable of acquiring a signal indicating an input speech with no noise contained, which makes it possible to achieve highly accurate speech recognition and speech authentication, and command generation processing.

Further, when the speech input device 2 is applied to a microphone system, a voice of a user output from a loudspeaker as well is canceled as a noise. Therefore, it is possible to provide a microphone system hardly causing acoustic feedback.

Figure 10:
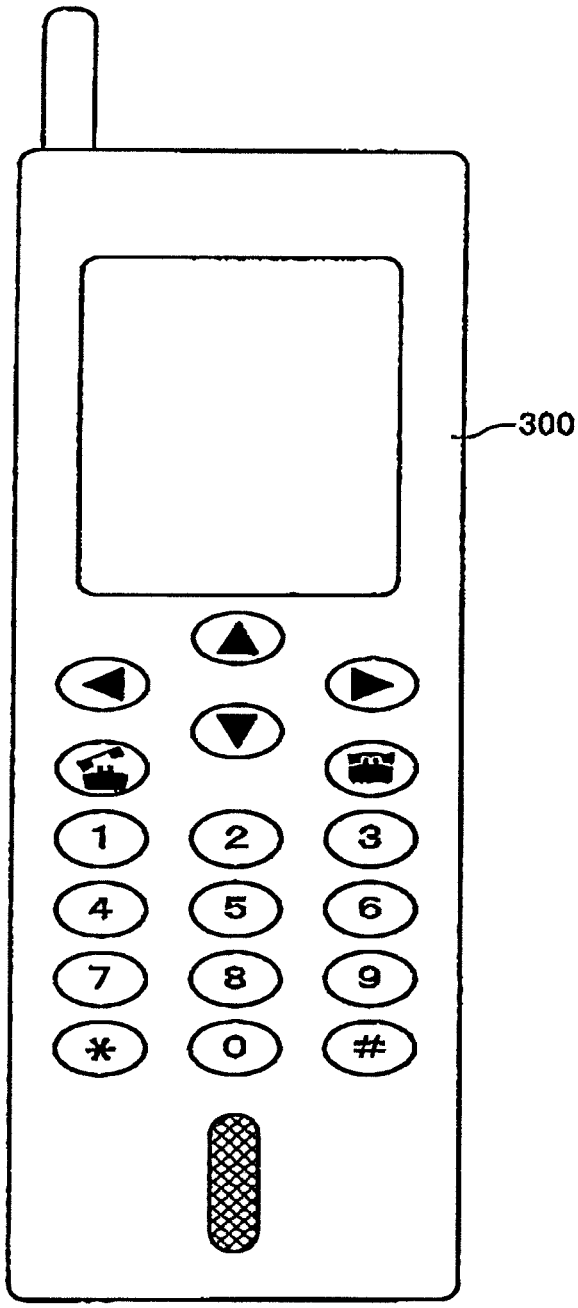
FIG. 10 is a view showing a mobile telephone as an example of the speech input device.
Figure 11:
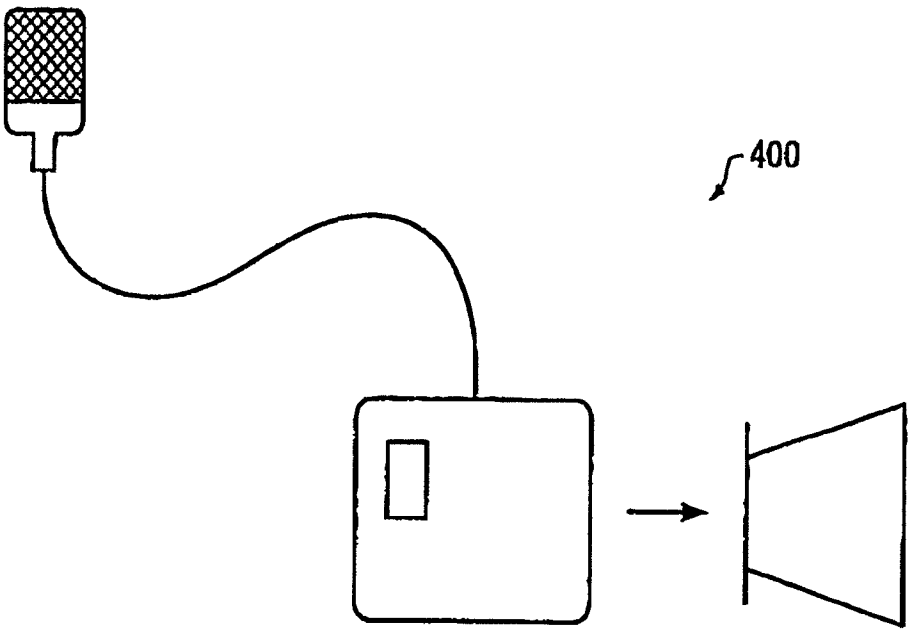
FIG. 11 is a view showing a microphone as an example of the speech input device.
Figure 12:
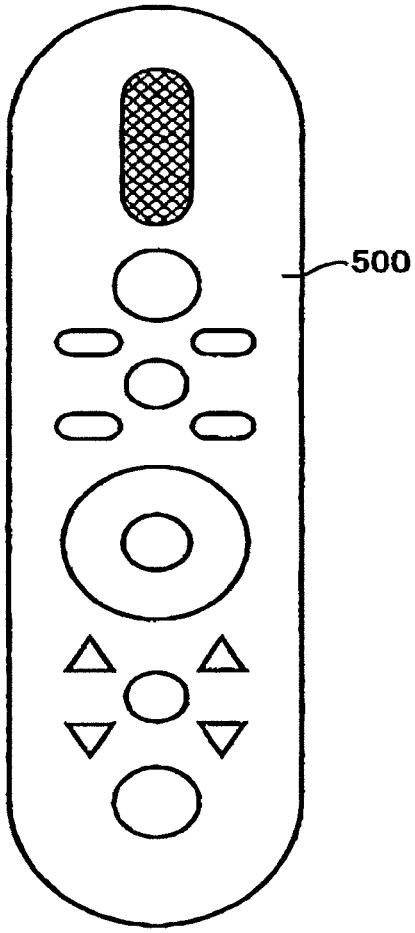
FIG. 12 is a view showing a remote controller as an example of the speech input device.
Figure 13:
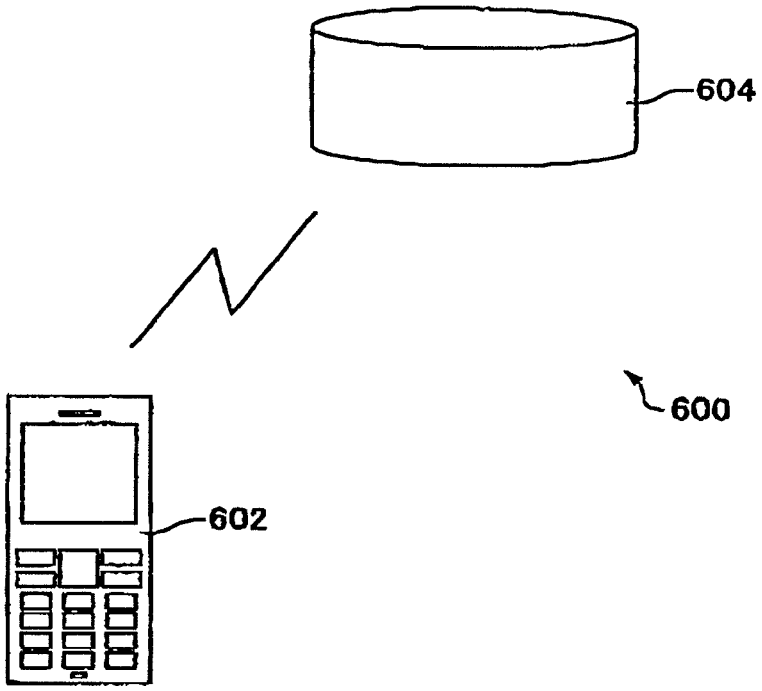
FIG. 13 is a schematic view of an information processing system.

FIGS. 10 to 12 respectively show a mobile telephone 300, a microphone (microphone system) 400, and a remote controller 500 as examples of the speech input device 2. Further, FIG. 13 shows a schematic view of an information processing system 600 including a speech input device 602 and a host computer 604 as information input devices.

7. MODIFIED EXAMPLES

In addition, the present invention is not limited to the embodiment described above, and various modifications are possible. The present invention contains configurations substantially the same as the configurations described in the embodiments (for example, configurations which are the same in function, method and result, or configurations which are the same in object and effect). Further, the present invention contains configurations in which unessential portions in the configurations described in the embodiments are replaced. Further, the present invention contains configurations with which it is possible to perform the same actions and effects or configurations with which it is possible to achieve the same object as the configurations described in the embodiments. Further, the present invention contains configurations in which publicly known technologies are added to the configurations described in the embodiments.

Hereinafter, concrete modified examples are shown.

(1) First Modified Example

Figure 14:
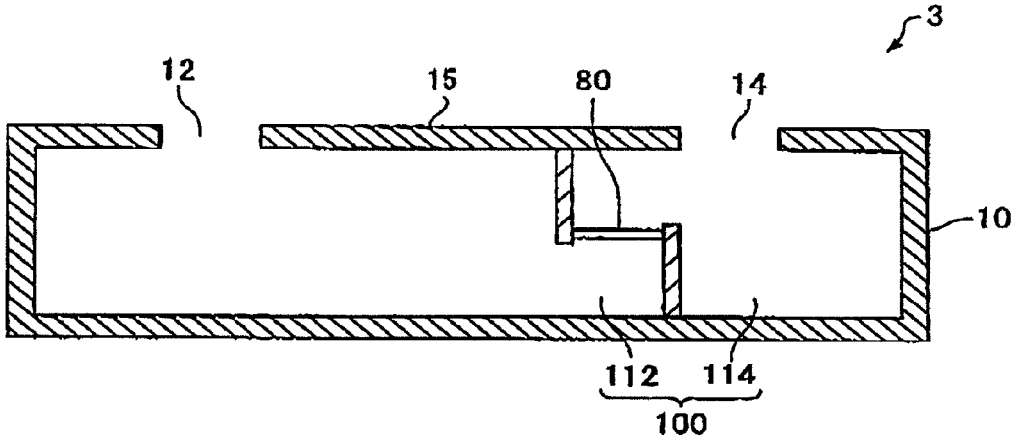
FIG. 14 is a view for explanation of a microphone unit according to a modified example.

FIG. 14 shows a microphone unit 3 according to a first modified example of the embodiment to which the present embodiment is applied.

The microphone unit 3 includes a vibrating membrane 80. The vibrating membrane 80 composes a part of a partition member, which splits the internal space 100 of the case 10 into a first space 112 and a second space 114. The vibrating membrane 80 is provided such that its normal is perpendicular to the surface 15 (i.e., so as to be parallel to the surface 15). The vibrating membrane 80 may be provided beside the second through hole 14 so as not to overlap with the first through hole 12 and the second through hole 14 (at a position other than the places under the first through hole 12 and the second through hole 14). Further, the vibrating membrane 80 may be disposed with an interval from the inner wall surface of the case 10.

(2) Second Modified Example

Figure 15:
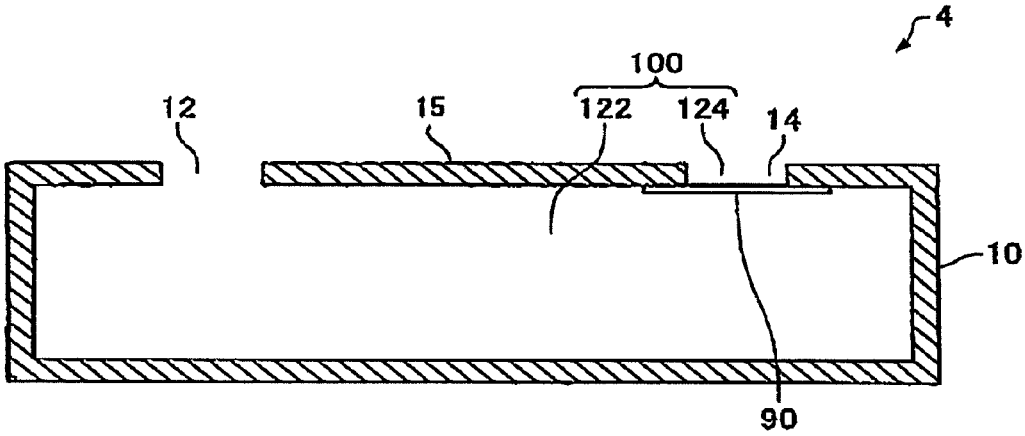
FIG. 15 is a view for explanation of a microphone unit according to a modified example.

FIG. 15 shows a microphone unit 4 according to a second modified example of the embodiment to which the present embodiment is applied.

The microphone unit 4 includes a vibrating membrane 90. The vibrating membrane 90 composes a part of a partition member, which splits the internal space 100 of the case 10 into a first space 122 and a second space 124. The vibrating membrane 90 is provided such that its normal is perpendicular to the surface 15. The vibrating membrane 90 may be provided so as to be flat on the same plane of the inner wall surface (the surface on the opposite side of the surface 15) of the case 10. The vibrating membrane 90 may be provided so as to block the second through hole 14 from the inner side of the case 10 (the side of the internal space 100). That is, in the microphone unit 4, the space on the inner side of the second through hole 14 may be the second space 124, and the space other than the second space 124 in the internal space 100 may be the first space 122. Thereby, it is possible to design the case 10 to be thin.

(3) Third Modified Example

Figure 16:
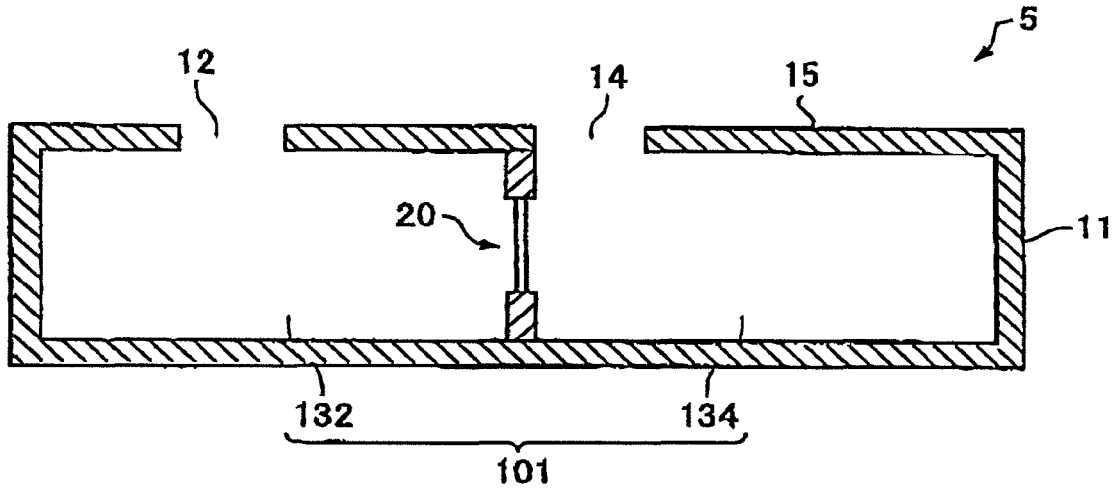
FIG. 16 is a view for explanation of a microphone unit according to a modified example.

FIG. 16 shows a microphone unit 5 according to a third modified example of the embodiment to which the present embodiment is applied.

The microphone unit 5 includes a case 11. An internal space 101 is formed inside the case 11. Then, the internal space 101 of the case 11 is split into a first space 132 and a second space 134 with the partition member 20. In the microphone unit 5, the partition member 20 is disposed beside the second through hole 14. Further, in the microphone unit 5, the partition member 20 splits the internal space 101 such that the volumes of the first space 132 and the second space 134 are equalized.

(4) Fourth Modified Example

Figure 17:
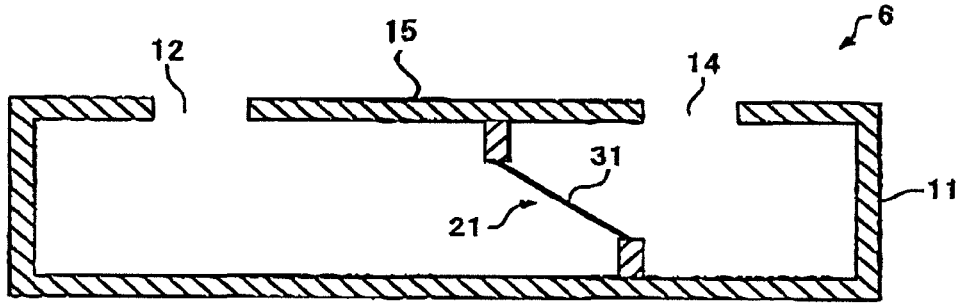
FIG. 17 is a view for explanation of a microphone unit according to a modified example.

FIG. 17 shows a microphone unit 6 according to a fourth modified example of the embodiment to which the present embodiment is applied.

The microphone unit 6 has a partition member 21 as shown in FIG. 17. Then, the partition member 21 has a vibrating membrane 31. The vibrating membrane 31 is held such that its normal obliquely intersects with the surface 15 inside the case 10.

(5) Fifth Modified Example

Figure 18:
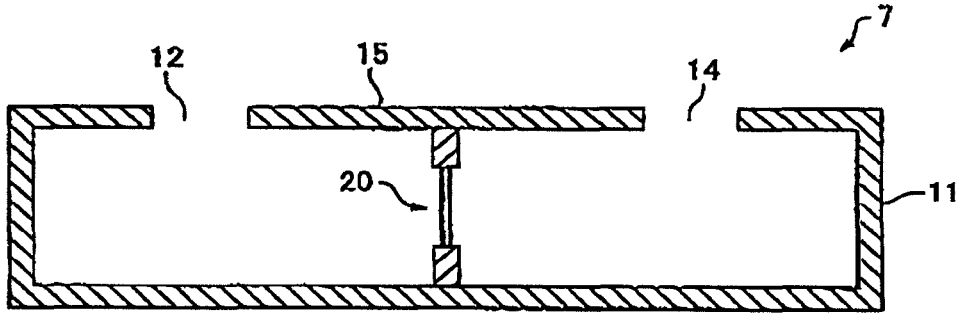
FIG. 18 is a view for explanation of a microphone unit according to a modified example.

FIG. 18 shows a microphone unit 7 according to a fifth modified example of the embodiment to which the present embodiment is applied.

In the microphone unit 7, as shown in FIG. 18, the partition member 20 is disposed at the midpoint between the first through hole 12 and the second through hole 14. That is, a distance between the first through hole 12 and the partition member 20 is equal to a distance between the second through hole 14 and the partition member 20. In addition, in the microphone unit 7, the partition member 20 may be disposed so as to uniformly split the internal space 100 of the case 10.

(6) Sixth Modified Example

Figure 19:
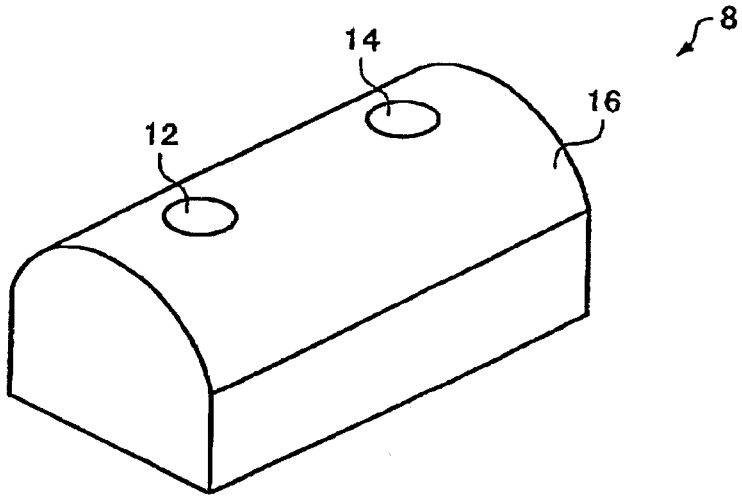
FIG. 19 is a view for explanation of a microphone unit according to a modified example.

FIG. 19 shows a microphone unit 8 according to a sixth modified example of the embodiment to which the present embodiment is applied.

In the microphone unit 8, as shown in FIG. 19, the case has a configuration having a convex curved surface 16. Then, the first through hole 12 and the second through hole 14 are formed in the convex curved surface 16.

(7) Seventh Modified Example

Figure 20:
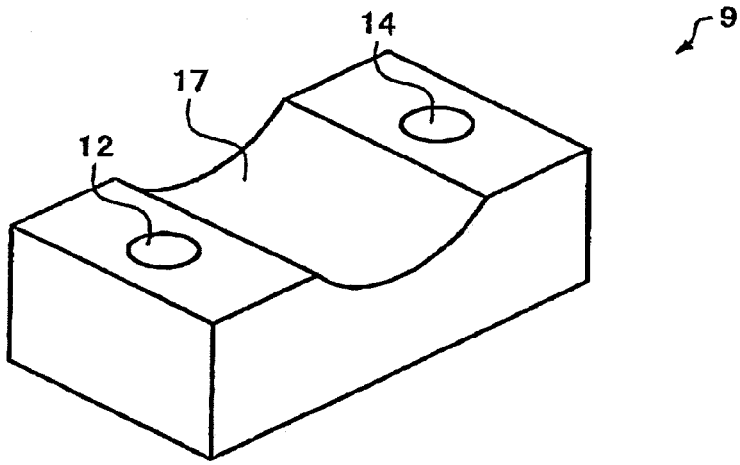
FIG. 20 is a view for explanation of a microphone unit according to a modified example.

FIG. 20 shows a microphone unit 9 according to a seventh modified example of the embodiment to which the present embodiment is applied.

In the microphone unit 9, as shown in FIG. 20, the case has a configuration having a concave curved surface 17. Then, the first through hole 12 and the second through hole 14 may be disposed on the both sides of the concave curved surface 17. Meanwhile, the first through hole 12 and the second through hole 14 may be formed in the concave curved surface 17.

(8) Eighth Modified Example

Figure 21:
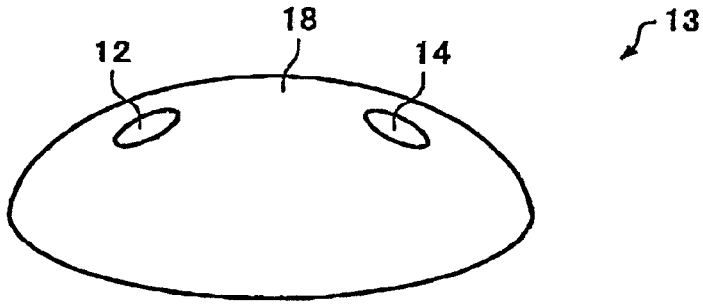
FIG. 21 is a view for explanation of a microphone unit according to a modified example.

FIG. 21 shows a microphone unit 13 according to an eighth modified example of the embodiment to which the present embodiment is applied.

In the microphone unit 13, as shown in FIG. 21, the case has a configuration having a spherical surface 18. In addition, the bottom surface of the spherical surface 18 may be a circular shape. Meanwhile, the bottom surface of the spherical surface 18 is not limited thereto, and the bottom surface may be an ellipse. Then, the first through hole 12 and the second through hole 14 are formed in the spherical surface 18.

With these microphone units, it is also possible to perform the same effects described above. Therefore, it is possible to acquire an electrical signal indicating a user speech with no noise contained component by acquiring an electrical signal on the basis of vibration of the vibrating membrane.

This application is based on Japanese Patent Application (JP-A-2008-083294), filed on Mar. 27, 2008, and the contents of which are incorporated herein by reference.

The invention claimed is:

1. A microphone unit comprising:

a case having an internal space;

a partition member provided in the case and at least partially composed of a vibrating membrane, wherein the partition member splits the internal space into a first space and a second space; and an electrical signal output circuit that outputs an electrical signal on the basis of vibration of the vibrating membrane, wherein a first through hole through which the first space and an external space of the case are communicated with each other, and a second through hole through which the second space and the external space of the case are communicated with each other are formed in the case, wherein a center-to-center distance between the first and second through holes is set to a distance within a range in which sound pressure in a case where the vibrating membrane is used as a differential microphone does not exceed sound pressure in a case where the vibrating membrane is used as a single microphone with respect to a sound in a frequency band less than or equal to 10 kHz.

2. The microphone unit according to claim 1, wherein an outer shape of the case is a polyhedron, and the first and second through holes are formed in one surface of the polyhedron.

3. The microphone unit according to claim 1, wherein a center-to-center distance between the first and second through holes is 5.2 mm or less.

4. The microphone unit according to claim 1, wherein the vibrating membrane is composed of a transducer having SN ratio of 60 decibels or more.

5. A microphone unit comprising:

a case having an internal space;

a partition member provided in the case and at least partially composed of a vibrating membrane, wherein the partition member splits the internal space into a first space and a second space; and an electrical signal output circuit that outputs an electrical signal on the basis of vibration of the vibrating membrane, wherein a first through hole through which the first space and an external space of the case are communicated with each other, and a second through hole through which the second space and the external space of the case are communicated with each other are formed in the case, wherein a center-to-center distance between the first and second through holes is set to a distance within a range in which sound pressure in a case where the vibrating membrane is used as a differential microphone does not exceed sound pressure in a case where the vibrating membrane is used as a single microphone in all directions with respect to a sound in an extractive target frequency band.

6. The microphone unit according to claim 5, wherein an outer shape of the case is a polyhedron, and the first and second through holes are formed in one surface of the polyhedron.

7. The microphone unit according to claim 5, wherein a center-to-center distance between the first and second through holes is 5.2 mm or less.

8. The microphone unit according to claim 5, wherein the vibrating membrane is composed of a transducer having SN ratio of 60 decibels or more.

9. A close-talking type speech input device in which a microphone unit is mounted, the microphone unit comprising:

a case having an internal space;

a partition member provided in the case and at least partially composed of a vibrating membrane, wherein the partition member splits the internal space into a first space and a second space; and an electrical signal output circuit that outputs an electrical signal on the basis of vibration of the vibrating membrane, wherein a first through hole through which the first space and an external space of the case are communicated with each other, and a second through hole through which the second space and the external space of the case are communicated with each other are formed in the case, wherein a center-to-center distance between the first and second through holes is set to a distance within a range in which sound pressure in a case where the vibrating membrane is used as a differential microphone does not exceed sound pressure in a case where the vibrating membrane is used as a single microphone with respect to a sound in a frequency band less than or equal to 10 kHz.

10. The speech input device according to claim 9, wherein an outer shape of the case is a polyhedron, and the first and second through holes are formed in one surface of the polyhedron.

11. The speech input device according to claim 9, wherein a center-to-center distance between the first and second through holes is 5.2 mm or less.

12. The speech input device according to claim 9, wherein the vibrating membrane is composed of a transducer having SN ratio of 60 decibels or more.

13. A close-talking type speech input device in which a microphone unit is mounted, the microphone unit comprising:

a case having an internal space;

a partition member provided in the case and at least partially composed of a vibrating membrane, wherein the partition member splits the internal space into a first space and a second space; and an electrical signal output circuit that outputs an electrical signal on the basis of vibration of the vibrating membrane, wherein a first through hole through which the first space and an external space of the case are communicated with each other, and a second through hole through which the second space and the external space of the case are communicated with each other are formed in the case, wherein a center-to-canter distance between the first and second through holes is set to a distance within a range in which sound pressure in a case where the vibrating membrane is used as a differential microphone does not exceed sound pressure in a case where the vibrating membrane is used as a single microphone in all directions with respect to a sound in an extractive target frequency band.

14. The close-talking type speech input device according to claim 13, wherein an outer shape of the case is a polyhedron, and the first and second through holes are formed in one surface of the polyhedron.

15. The microphone unit according to claim 13, wherein a center-to-center distance between the first and second through holes is 5.2 mm or less.

16. The microphone unit according to claim 13, wherein the vibrating membrane is composed of a transducer having SN ratio of 60 decibels or more.

* * * * *